US008287694B2

(12) United States Patent
Schulz

(10) Patent No.: US 8,287,694 B2
(45) **Date of Patent: *Oct. 16, 2012**

(54) APPARATUS AND METHOD FOR DEGRADING A WEB IN THE MACHINE DIRECTION WHILE PRESERVING CROSS-MACHINE DIRECTION STRENGTH

(75) Inventor: Galyn A. Schulz, Greenville, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 6 days.

This patent is subject to a terminal disclaimer.

(21) Appl. No.: 12/857,812

(22) Filed: Aug. 17, 2010

(65) Prior Publication Data

US 2010/0307704 A1 Dec. 9, 2010

Related U.S. Application Data

(62) Division of application No. 11/868,556, filed on Oct. 8, 2007, now Pat. No. 7,799,176, which is a division of application No. 10/775,252, filed on Feb. 11, 2004, now Pat. No. 7,297,226.

(51) Int. Cl.
*D21H 27/02* (2006.01)
*B31F 1/07* (2006.01)

(52) U.S. Cl. ..... 162/362; 162/117; 101/23

(58) Field of Classification Search ..... 162/117, 162/361, 362; 101/23, 32; 493/467; 428/179; 264/284; 425/329, 363, 385, 406; 156/209; 100/161, 162 R See application file for complete search history.

(56) References Cited

U.S. PATENT DOCUMENTS

| | | | |
|---|---|---|---|
| D34,028 | S | 2/1901 | Ault |
| 673,041 | A | 4/1901 | Ault |
| 1,224,650 | A | 5/1917 | Kitchen |
| 1,284,517 | A | 11/1918 | Whitney |
| 1,384,515 | A | 7/1921 | Conradson et al. |
| 1,403,629 | A | 1/1922 | Price |
| 2,662,002 | A | 12/1953 | Sunderfauf et al. |
| 2,771,363 | A | 11/1956 | Fish |
| 2,803,188 | A | 8/1957 | Duvall |
| 2,878,553 | A | 3/1959 | Hirsch |
| 3,236,685 | A | 2/1966 | Caldwell |

(Continued)

FOREIGN PATENT DOCUMENTS

| | | |
|---|---|---|
| BE | 870609 | 9/1978 |

(Continued)

OTHER PUBLICATIONS

U.S. Appl. No. 09/709,185.

(Continued)

*Primary Examiner* — Eric Hug
(74) *Attorney, Agent, or Firm* — Laura L. Bozek

(57) ABSTRACT

An embossing system for embossing at least a portion of a web is provided comprising a first embossing roll having male embossing elements, a second embossing roll having male embossing elements, wherein the first and second embossing rolls define a first nip for receiving the web, and a third embossing roll having male embossing elements, wherein the second and third embossing rolls define a second nip for receiving the web, and wherein at least a substantial portion of the embossing elements of at least one of the first, second, and third embossing rolls are substantially oriented in the cross-machine direction.

6 Claims, 31 Drawing Sheets

U.S. PATENT DOCUMENTS

| | | | | |
|---|---|---|---|---|
| 3,264,978 | A | | 8/1966 | Staley |
| 3,301,746 | A | | 1/1967 | Sanford et al. |
| 3,337,388 | A | | 8/1967 | Wosaba, II |
| 3,377,224 | A | * | 4/1968 | Gresham et al. ..... 156/209 |
| 3,387,351 | A | | 6/1968 | Roosen |
| 3,545,705 | A | | 12/1970 | Hodgson |
| 3,549,742 | A | | 12/1970 | Benz |
| 3,556,932 | A | | 1/1971 | Coscia et al. |
| 3,556,933 | A | | 1/1971 | Williams et al. |
| RE27,201 | E | | 10/1971 | Mittman |
| RE27,453 | E | | 8/1972 | Schutte et al. |
| 3,700,623 | A | | 10/1972 | Keim |
| 3,707,752 | A | | 1/1973 | Brafford et al. |
| 3,756,760 | A | | 9/1973 | McBride |
| 3,772,076 | A | | 11/1973 | Keim |
| 3,803,936 | A | | 4/1974 | Kroeper |
| 3,858,623 | A | | 1/1975 | Lefkowitz |
| 3,905,863 | A | | 9/1975 | Ayers |
| 3,925,127 | A | | 12/1975 | Yoshioka |
| 3,930,935 | A | | 1/1976 | Muller et al. |
| 3,940,529 | A | | 2/1976 | Hepford et al. |
| 3,953,638 | A | | 4/1976 | Kemp |
| 3,974,025 | A | | 8/1976 | Ayers |
| 3,985,600 | A | * | 10/1976 | Blais ..... 156/229 |
| 4,000,242 | A | | 12/1976 | Hartbauer |
| 4,041,989 | A | | 8/1977 | Johansson et al. |
| 4,071,050 | A | | 1/1978 | Codorniu |
| 4,073,993 | A | | 2/1978 | Lark |
| 4,112,982 | A | | 9/1978 | Bugge et al. |
| 4,125,659 | A | | 11/1978 | Klowak et al. |
| 4,127,637 | A | | 11/1978 | Pietreniak et al. |
| 4,149,571 | A | | 4/1979 | Burroughs |
| 4,157,276 | A | | 6/1979 | Wandel et al. |
| 4,161,195 | A | | 7/1979 | Khan |
| 4,166,758 | A | | 9/1979 | Watanabe et al. |
| 4,182,381 | A | | 1/1980 | Gisbourne |
| 4,184,519 | A | | 1/1980 | McDonald et al. |
| 4,191,609 | A | | 3/1980 | Trokhan |
| 4,211,743 | A | | 7/1980 | Nauta et al. |
| 4,239,065 | A | | 12/1980 | Trokhan |
| 4,280,978 | A | | 7/1981 | Dannheim et al. |
| 4,314,589 | A | | 2/1982 | Buchanen et al. |
| 4,324,177 | A | | 4/1982 | Tsuji et al. |
| 4,325,768 | A | | 4/1982 | Schulz |
| 4,325,773 | A | | 4/1982 | Schulz |
| 4,326,002 | A | | 4/1982 | Schulz |
| D264,512 | S | | 5/1982 | Rogers |
| 4,356,059 | A | | 10/1982 | Hostetler |
| 4,359,069 | A | | 11/1982 | Hahn |
| 4,361,085 | A | | 11/1982 | Schutz |
| 4,376,455 | A | | 3/1983 | Hahn |
| 4,379,735 | A | | 4/1983 | MacBean |
| 4,453,573 | A | | 6/1984 | Thompson |
| 4,469,735 | A | | 9/1984 | Trokhan |
| 4,514,345 | A | | 4/1985 | Johnson et al. |
| 4,528,339 | A | | 7/1985 | Coleman, III et al. |
| 4,529,480 | A | | 7/1985 | Trokhan |
| 4,564,052 | A | | 1/1986 | Borel |
| 4,581,087 | A | | 4/1986 | Johnson |
| 4,592,395 | A | | 6/1986 | Borel |
| 4,603,176 | A | | 7/1986 | Bjorkquist et al. |
| 4,605,585 | A | | 8/1986 | Johansson |
| 4,611,639 | A | | 9/1986 | Bugge |
| 4,637,859 | A | | 1/1987 | Trokhan |
| 4,640,741 | A | | 2/1987 | Tsuneo |
| 4,655,877 | A | | 4/1987 | Horimoto et al. |
| 4,671,983 | A | | 6/1987 | Burt |
| 4,675,394 | A | | 6/1987 | Solarek et al. |
| 4,709,732 | A | | 12/1987 | Kinnunen |
| 4,720,383 | A | | 1/1988 | Drach et al. |
| 4,759,391 | A | | 7/1988 | Waldvogel et al. |
| 4,759,967 | A | | 7/1988 | Bauernfeind |
| 4,759,976 | A | | 7/1988 | Dutt |
| 4,787,837 | A | | 11/1988 | Bell |
| 4,803,032 | A | | 2/1989 | Schulz |
| 4,804,378 | A | | 2/1989 | Shiba et al. |
| 4,804,769 | A | | 2/1989 | Solarek et al. |
| 4,814,412 | A | | 3/1989 | Crowther et al. |
| 4,859,519 | A | | 8/1989 | Cabe, Jr. et al. |
| 4,866,151 | A | | 9/1989 | Tsai et al. |
| 4,902,366 | A | | 2/1990 | Bader |
| 4,906,513 | A | | 3/1990 | Kebbell et al. |
| 4,942,077 | A | | 7/1990 | Wendt et al. |
| 4,973,512 | A | | 11/1990 | Stanley et al. |
| 4,981,557 | A | | 1/1991 | Bjorkquist |
| 4,983,748 | A | | 1/1991 | Tsai et al. |
| 4,998,568 | A | | 3/1991 | Vohringer |
| 4,999,235 | A | | 3/1991 | Lunn et al. |
| 5,008,344 | A | | 4/1991 | Bjorkquist |
| 5,016,678 | A | | 5/1991 | Borel et al. |
| 5,019,211 | A | | 5/1991 | Sauer |
| 5,023,132 | A | | 6/1991 | Stanley et al. |
| 5,030,500 | A | | 7/1991 | Perdelwitz, Jr. et al. |
| 5,054,525 | A | | 10/1991 | Vohringer |
| 5,066,532 | A | | 11/1991 | Gaisser |
| 5,085,736 | A | | 2/1992 | Bjorkquist |
| 5,085,914 | A | | 2/1992 | Perdelwitz, Jr. et al. |
| 5,093,068 | A | | 3/1992 | Schulz |
| 5,094,717 | A | | 3/1992 | Manning et al. |
| 5,098,519 | A | | 3/1992 | Ramasubramanian et al. |
| 5,103,874 | A | | 4/1992 | Lee |
| 5,114,777 | A | | 5/1992 | Gaisser |
| 5,138,002 | A | | 8/1992 | Bjorkquist |
| 5,160,789 | A | | 11/1992 | Barcus et al. |
| 5,167,261 | A | | 12/1992 | Lee |
| 5,167,764 | A | | 12/1992 | Nielsen et al. |
| 5,182,164 | A | | 1/1993 | Eklund et al. |
| 5,199,467 | A | | 4/1993 | Lee |
| 5,211,815 | A | | 5/1993 | Ramasubramanian et al. |
| 5,215,617 | A | | 6/1993 | Grupe |
| 5,217,576 | A | | 6/1993 | Van Phan |
| 5,219,004 | A | | 6/1993 | Chiu |
| 5,223,096 | A | | 6/1993 | Phan et al. |
| 5,225,269 | A | | 7/1993 | Bohlin |
| 5,230,959 | A | | 7/1993 | Young, Sr. et al. |
| 5,233,092 | A | | 8/1993 | Zaosheng |
| 5,240,562 | A | | 8/1993 | Phan et al. |
| 5,245,025 | A | | 9/1993 | Trokhan et al. |
| 5,254,399 | A | | 10/1993 | Oku et al. |
| 5,258,220 | A | | 11/1993 | Joseph |
| 5,260,171 | A | | 11/1993 | Smurkoski et al. |
| 5,262,007 | A | | 11/1993 | Phan et al. |
| 5,264,082 | A | | 11/1993 | Phan et al. |
| D341,944 | S | | 12/1993 | Peter |
| 5,269,983 | A | | 12/1993 | Schulz |
| 5,275,799 | A | | 1/1994 | Keijsper et al. |
| 5,277,761 | A | | 1/1994 | Van Phan et al. |
| 5,312,522 | A | | 5/1994 | Van Phan et al. |
| 5,314,584 | A | | 5/1994 | Grinnell et al. |
| 5,328,565 | A | | 7/1994 | Rasch et al. |
| 5,334,289 | A | | 8/1994 | Trokhan et al. |
| 5,356,364 | A | | 10/1994 | Veith et al. |
| 5,360,420 | A | | 11/1994 | Cook et al. |
| 5,364,504 | A | | 11/1994 | Smurkoski et al. |
| 5,368,696 | A | | 11/1994 | Cunnane, III et al. |
| 5,372,876 | A | | 12/1994 | Johnson et al. |
| 5,379,808 | A | | 1/1995 | Chiu |
| 5,383,778 | A | | 1/1995 | Schulz |
| 5,387,172 | A | | 2/1995 | Habenicht et al. |
| 5,387,385 | A | | 2/1995 | Murji et al. |
| 5,388,803 | A | | 2/1995 | Baumgartner et al. |
| 5,406,705 | A | | 4/1995 | Kildune |
| 5,415,737 | A | | 5/1995 | Phan et al. |
| 5,429,686 | A | | 7/1995 | Chiu et al. |
| 5,443,899 | A | | 8/1995 | Barcus et al. |
| 5,456,293 | A | | 10/1995 | Ostermayer et al. |
| 5,456,982 | A | | 10/1995 | Hansen et al. |
| 5,489,469 | A | | 2/1996 | Kobayashi et al. |
| 5,490,902 | A | | 2/1996 | Schulz |
| 5,494,554 | A | | 2/1996 | Edwards et al. |
| 5,498,478 | A | | 3/1996 | Hansen et al. |
| 5,503,896 | A | | 4/1996 | Veith et al. |
| 5,529,563 | A | | 6/1996 | Veith et al. |
| 5,540,964 | A | | 7/1996 | Mallen |
| 5,543,202 | A | | 8/1996 | Clark et al. |
| 5,549,790 | A | | 8/1996 | Van Phan |
| 5,556,509 | A | | 9/1996 | Trokhan et al. |

| | | | | |
|---|---|---|---|---|
| 5,562,805 | A | 10/1996 | Kamps et al. | |
| D375,844 | S | 11/1996 | Edwards et al. | |
| 5,618,612 | A | 4/1997 | Gstrein | |
| 5,622,734 | A | 4/1997 | Clark et al. | |
| 5,637,194 | A | 6/1997 | Ampulski et al. | |
| 5,656,134 | A | 8/1997 | Marinack et al. | |
| 5,657,797 | A | 8/1997 | Townley et al. | |
| 5,660,092 | A | 8/1997 | Scholz et al. | |
| 5,674,590 | A | 10/1997 | Anderson et al. | |
| 5,690,788 | A | 11/1997 | Marinack et al. | |
| 5,698,291 | A | 12/1997 | Clark et al. | |
| 5,702,571 | A | 12/1997 | Kamps et al. | |
| 5,704,101 | A | 1/1998 | Majors et al. | |
| 5,727,458 | A | 3/1998 | Schulz | |
| 5,753,165 | A | 5/1998 | Watanabe et al. | |
| 5,763,334 | A | 6/1998 | Gupta et al. | |
| 5,776,306 | A | 7/1998 | Hepford | |
| 5,776,307 | A | 7/1998 | Ampulski et al. | |
| 5,776,312 | A | 7/1998 | Trokhan et al. | |
| 5,779,965 | A | 7/1998 | Beuther et al. | |
| 5,814,190 | A | 9/1998 | Van Phan | |
| 5,820,973 | A | 10/1998 | Dodge, II et al. | |
| 5,834,384 | A | 11/1998 | Cohen et al. | |
| 5,837,103 | A | 11/1998 | Trokhan et al. | |
| 5,843,063 | A | 12/1998 | Anderson et al. | |
| 5,851,353 | A | 12/1998 | Fiscus et al. | |
| 5,851,355 | A | 12/1998 | Goettmann et al. | |
| 5,861,081 | A | 1/1999 | Bredendick et al. | |
| 5,861,082 | A | 1/1999 | Ampulski et al. | |
| 5,879,343 | A | 3/1999 | Dodge, II et al. | |
| 5,885,415 | A | 3/1999 | Marinack et al. | |
| 5,904,811 | A | 5/1999 | Ampulski et al. | |
| 5,945,131 | A | 8/1999 | Harvey et al. | |
| 5,976,694 | A | 11/1999 | Tsai et al. | |
| 5,994,615 | A | 11/1999 | Dodge, II et al. | |
| 6,004,669 | A | 12/1999 | Rokutan et al. | |
| 6,007,468 | A | 12/1999 | Giacometti | |
| 6,042,692 | A | 3/2000 | Myren | |
| 6,054,202 | A | 4/2000 | Takeuchi et al. | |
| 6,074,192 | A | 6/2000 | Mikkelsen | |
| 6,080,276 | A | 6/2000 | Burgess | |
| 6,087,469 | A | 7/2000 | Epple et al. | |
| 6,096,015 | A | 8/2000 | Yeo et al. | |
| 6,106,928 | A | 8/2000 | Laurent et al. | |
| 6,109,326 | A * | 8/2000 | Leakey et al. | 156/553 |
| 6,121,170 | A | 9/2000 | Tsai et al. | |
| 6,136,124 | A | 10/2000 | Wanger | |
| 6,136,775 | A | 10/2000 | Strout et al. | |
| 6,146,496 | A | 11/2000 | Phan | |
| 6,149,768 | A | 11/2000 | Hepford | |
| 6,162,327 | A | 12/2000 | Batra et al. | |
| 6,165,298 | A | 12/2000 | Samida et al. | |
| D436,738 | S | 1/2001 | Bredendick et al. | |
| 6,187,139 | B1 | 2/2001 | Edwards et al. | |
| 6,193,839 | B1 | 2/2001 | Ampulski et al. | |
| 6,200,419 | B1 | 3/2001 | Phan | |
| 6,210,528 | B1 | 4/2001 | Wolkowicz | |
| 6,211,306 | B1 | 4/2001 | Epple et al. | |
| 6,214,146 | B1 | 4/2001 | Merker | |
| 6,228,296 | B1 | 5/2001 | Cartmill et al. | |
| 6,235,663 | B1 | 5/2001 | Dahringer et al. | |
| 6,248,211 | B1 | 6/2001 | Jennings et al. | |
| 6,258,897 | B1 | 7/2001 | Epple et al. | |
| 6,261,666 | B1 * | 7/2001 | Enderby et al. | 428/172 |
| 6,277,241 | B1 | 8/2001 | Merker et al. | |
| 6,287,421 | B1 | 9/2001 | Dwiggins et al. | |
| 6,315,114 | B1 | 11/2001 | Keck et al. | |
| 6,344,111 | B1 | 2/2002 | Wilhelm | |
| 6,348,131 | B1 | 2/2002 | Kershaw et al. | |
| 6,355,200 | B1 | 3/2002 | Schmidt et al. | |
| 6,383,958 | B1 | 5/2002 | Swanson et al. | |
| 6,395,211 | B1 | 5/2002 | Dettmer et al. | |
| 6,432,527 | B1 | 8/2002 | Perez et al. | |
| 6,440,267 | B1 | 8/2002 | Rekoske et al. | |
| 6,455,129 | B1 | 9/2002 | Kershaw et al. | |
| 6,520,896 | B1 | 2/2003 | Sohl | |
| 6,635,334 | B1 * | 10/2003 | Jackson et al. | 428/136 |
| 6,692,603 | B1 | 2/2004 | Lindsay et al. | |
| 6,733,626 | B2 | 5/2004 | Ruthven et al. | |
| 6,739,024 | B1 * | 5/2004 | Wagner | 28/106 |
| 6,832,546 | B2 | 12/2004 | Bredahl et al. | |
| 6,887,349 | B2 | 5/2005 | Ruthven et al. | |
| 6,896,767 | B2 | 5/2005 | Wilhelm | |
| 7,037,406 | B2 | 5/2006 | Kershaw et al. | |
| 7,147,453 | B2 * | 12/2006 | Boegli | 425/363 |
| 7,182,838 | B2 | 2/2007 | Ruthven et al. | |
| 7,323,072 | B2 * | 1/2008 | Engelhart et al. | 156/73.2 |
| 7,326,322 | B2 | 2/2008 | Ruthven et al. | |
| 7,799,176 | B2 * | 9/2010 | Schulz | 162/362 |
| 2001/0040136 | A1 | 11/2001 | Wei et al. | |
| 2002/0142143 | A1 | 10/2002 | Schulz et al. | |
| 2002/0168518 | A1 | 11/2002 | Bond et al. | |
| 2003/0026950 | A1 | 2/2003 | Kershaw et al. | |
| 2003/0045412 | A1 | 3/2003 | Schulz et al. | |
| 2003/0106657 | A1 | 6/2003 | Baggot | |
| 2003/0138597 | A1 | 7/2003 | Ruthven | |
| 2003/0159600 | A1 | 8/2003 | Ruthven | |
| 2004/0055694 | A1 | 3/2004 | Kershaw et al. | |
| 2004/0140048 | A1 | 7/2004 | Lindsay et al. | |
| 2004/0163783 | A1 | 8/2004 | Muller | |
| 2004/0180178 | A1 | 9/2004 | Ruthven et al. | |
| 2004/0200590 | A1 | 10/2004 | Wilhelm | |
| 2004/0209058 | A1 | 10/2004 | Chou et al. | |
| 2005/0092195 | A1 | 5/2005 | Ruthven et al. | |

FOREIGN PATENT DOCUMENTS

| | | | |
|---|---|---|---|
| DE | 288 611 | A5 | 9/1988 |
| EP | 0 136 368 | A2 | 4/1985 |
| EP | 0 313 766 | A2 | 5/1989 |
| EP | 0 371 946 | A2 | 6/1990 |
| EP | 0 465 203 | A1 | 1/1992 |
| EP | 0 488 452 | A2 | 6/1992 |
| EP | 0 498 623 | A2 | 8/1992 |
| EP | 0 566 775 | B1 | 12/1993 |
| EP | 0 810 078 | A1 | 3/1997 |
| EP | 0 806 520 | A1 | 11/1997 |
| EP | 0 836 928 | A1 | 4/1998 |
| EP | 0 916 692 | A1 | 5/1999 |
| EP | 1 050 612 | A1 | 11/2000 |
| EP | 1 216 818 | A2 | 6/2002 |
| GB | 2 007 561 | | 5/1979 |
| JP | 63-211350 | | 9/1988 |
| JP | 10-249916 | | 9/1998 |
| JP | 11-48310 | | 2/1999 |
| JP | 01-192954 | | 7/2001 |
| WO | WO 96/12615 | A1 | 5/1996 |
| WO | WO 96/18771 | A1 | 6/1996 |
| WO | WO 97/22742 | A2 | 6/1997 |
| WO | WO 99/25911 | A1 | 5/1999 |
| WO | WO 00/17241 | A1 | 3/2000 |
| WO | WO 00/24798 | A1 | 5/2000 |
| WO | WO 00/25835 | A1 | 5/2000 |
| WO | WO 00/33779 | A1 | 6/2000 |
| WO | WO 00/37518 | A1 | 6/2000 |
| WO | WO 01/24749 | A1 | 4/2001 |
| WO | WO 01/48314 | A2 | 7/2001 |

OTHER PUBLICATIONS

U.S. Appl. No. 10/036,770, filed Dec. 21, 2001.
U.S. Appl. No. 11/868,556, filed Oct. 8, 2007.
Office Action dated Jun. 19, 2003, in U.S. Appl. No. 10/036,770.
Office Action dated Jan. 5, 2004, in U.S. Appl. No. 10/036,770.
Office Action dated Feb. 27, 2004, in U.S. Appl. No. 10/107,415.
Office Action dated Aug. 11, 2004, in U.S. Appl. No. 10/107,415.
Office Action dated Feb. 17, 2005, in U.S. Appl. No. 10/107,415.
Office Action dated Jul. 26, 2005, in U.S. Appl. No. 10/107,415.
Office Action dated May 11, 2006, in U.S. Appl. No. 10/107,415.
Office Action dated Oct. 25, 2006, in U.S. Appl. No. 10/107,415.
Examiner's Answer dated Dec. 13, 2007, in U.S. Appl. No. 10/107,415.
Office Action dated Mar. 25, 2004, in U.S. Appl. No. 10/187,608.
Office Action dated Nov. 17, 2004, in U.S. Appl. No. 10/187,608.
Examiner's Answer to Appeal Brief dated Apr. 18, 2006, in U.S. Appl. No. 10/187,608.
Second Examiner's Answer to Appeal Brief dated Sep. 1, 2006, in U.S. Appl. No. 10/187,608.

Subsequent Examiner's Answer to Appeal Brief dated Feb. 22, 2007, in U.S. Appl. No. 10/187,608.
Subsequent Examiner's Answer to Appeal Brief dated Sep. 7, 2007, in U.S. Appl. No. 10/187,608.
Office Action dated May 9, 2003, in U.S. Appl. No. 10/235,197.
U.S. Appl. No. 10/236,993, filed Sep. 5, 2002.
Office Action dated Mar. 31, 2004, in U.S. Appl. No. 10/236,993.
Office Action dated Aug. 26, 2004, in U.S. Appl. No. 10/236,993.
U.S. Appl. No. 10/635,663, filed Aug. 6, 2003.
Office Action dated May 23, 2005, in U.S. Appl. No. 10/635,663.
Office Action dated Sep. 6, 2005, in U.S. Appl. No. 10/635,663.
Office Action dated Nov. 1, 2005, in U.S. Appl. No. 10/676,017.
Office Action dated Jun. 1, 2006, in U.S. Appl. No. 10/676,017.
Office Action dated Jan. 8, 2007, in U.S. Appl. No. 10/676,017.
Office Action dated Jun. 22, 2007, in U.S. Appl. No. 10/676,017.
Office Action dated Dec. 10, 2007, in U.S. Appl. No. 10/676,017.
U.S. Appl. No. 10/808,431, filed Mar. 25, 2004.
Office Action dated Nov. 2, 2005, in U.S. Appl. No. 10/808,431.
Office Action dated Apr. 24, 2006, in U.S. Appl. No. 10/808,431.
Office Action dated Sep. 18, 2006, in U.S. Appl. No. 10/808,431.
U.S. Appl. No. 10/986,034, filed Nov. 12, 2004.
Office Action dated Aug. 1, 2005, in U.S. Appl. No. 10/986,034.
Office Action dated Sep. 29, 2005, in U.S. Appl. No. 10/986,034.
Office Action dated Jan. 9, 2006, in U.S. Appl. No. 10/986,034.
Office Action dated Jun. 12, 2006, in U.S. Appl. No. 10/986,034.
Office Action dated Sep. 12, 2007, in U.S. Appl. No. 10/986,034.
B. W. Crouse, S. J. Dagan, and E. B. Warner, "*Properties of Thermoplastic Fiber/Cellulosic Stratified Composite Papers*", Tappi Journal, Jul. 1985, vol. 68, No. 7, pp. 94-97 (1985).
Christopher T. J. Dodson, "*Fiber Crowding, Fiber Contacts, and Fiber Flocculation*", Tappi Journal, vol. 79: No. 9, pp. 211-215 (1996).
International Standard—ISO 8251:1987 (E) *Anodixing Aluminum and Aluminum Alloys—Measurement of Wear Resistance and Wear Index of Anodic Oxidation Coatings with an Abrasive Wheel Wear Test Apparatus*.
R. J. Kerekes and C. J. Schell, "*Characterization of Fibre Flocculation Regimes by a Crowding Factor*", PPR 795, Pulp and Paper Reports, Pulp and Paper Research Institute of Canada, May 1990.
Rasmussen, J. *Microhardness and Wear Resistance in Type III Anodizing*, IHAA 7$^{th}$ Annual Symposium, San Diego, CA Oct. 10-14, 1998.
Smook, G. A., Handbook for Pulp and Paper Technologists, p. 111, 224-225, 228-229, 239, 250, 324, 339, and 346 (1992).
English-language abstract of BE 870,609.
English-language abstract of DE 288 611 A5.
English-language abstract of EP 0 136 368 A2.
English-language translation of EP 0 371 946 A2.
English-language abstract of EP 0 916 692 A1.
English-language abstract of JP 63-211350.
English-language abstract of JP 10-249916.
English-language abstract of JP 11-48310.
English-language translation of JP 11-48310.
English-language abstract of JP 01-192954.
English-language abstract of WO 96/18771 A1.
English-language abstract of WO 99/25911 A1.
English-language abstract of WO 01/48314 A2.
European Search Report for Application EP 02 25 4923 (U.S. Appl. No. 10/186,608).
European Search Report for Application EP 02 25 8801 (U.S. Appl. No. 10/236,993).
BPAI Decision dated Aug. 31, 2009, in U.S. Appl. No. 10/107,415.
Record of Oral Hearing issued Sep. 11, 2009, in U.S. Appl. No. 10/107,415.
Supplemental Examiner's Answer dated Dec. 15, 2008, in U.S. Appl. No. 10/187,608.
BPAI Decision dated Aug. 31, 2009, in U.S. Appl. No. 10/187,608.
Record of Oral Hearing issued Sep. 11, 2009, in U.S. Appl. No. 10/187,608.
U.S. Appl. No. 12/350,951, filed Jan. 8, 2009.
Office Action dated Sep. 8, 2009, in U.S. Appl. No. 12/350,951.

* cited by examiner

SECTION A-A

SIDE VIEW

AT .028 ENGAGEMENT

7° WALL ANGLE CENTERED ALIGNMENT

9° WALL ANGLE CENTERED ALIGNMENT

11° WALL ANGLE CENTERED ALIGNMENT

AT .024 ENGAGEMENT

7° WALL ANGLE CENTERED ALIGNMENT

9° WALL ANGLE CENTERED ALIGNMENT

11° WALL ANGLE CENTERED ALIGNMENT

STANDARD GEARS/HUBS

PRE-HEAT-TREATED GEARS/PRECISION HUBS

APPARATUS AND METHOD FOR DEGRADING A WEB IN THE MACHINE DIRECTION WHILE PRESERVING CROSS-MACHINE DIRECTION STRENGTH

This is a divisional of U.S. application Ser. No. 11/868,556, filed Oct. 8, 2007, which is a divisional of U.S. application Ser. No. 10/775,252, filed Feb. 11, 2004 (now U.S. Pat. No. 7,297,226), all of which are incorporated herein by reference.

FIELD OF THE INVENTION

The present invention relates to an apparatus and method for embossing a moving web of material, such as paper, to create a functional controlled degradation of the machine direction strength of the web while limiting degradation of the cross-machine direction strength of the web. In one embodiment, the present invention relates to an apparatus and method for embossing a moving web using an embossing system having at least a portion of the embossing elements substantially oriented in the cross-machine direction to improve the flexibility, feel, bulk, and absorbency of the paper.

Embossing is the act of mechanically working a substrate to cause the substrate to conform under pressure to the depths and contours of a patterned embossing roll. Generally the web is passed between a pair of embossing rolls that, under pressure, form contours within the surface of the web. During an embossing process, the roll pattern is imparted onto the web at a certain pressure and/or penetration.

Embossing is commonly used to modify the properties of a web to make a final product produced from that web more appealing to the consumer. For example, embossing a web can improve the softness, absorbency, and bulk of the final product. Embossing can also be used to impart an appealing pattern to a final product. Moreover, the embossing pattern can be changed or selected to meet a consumer's particular preference.

Embossing is carried out by passing a web between two or more embossing rolls, at least one of which carries the desired emboss pattern. Known embossing configurations include rigid-to-resilient embossing and rigid-to-rigid embossing.

In a rigid-to-resilient embossing system, a single or multi-ply substrate is passed through a nip formed between a roll whose substantially rigid surface contains the embossing pattern as a multiplicity of protuberances and/or depressions arranged in an aesthetically-pleasing manner, and a second roll, whose substantially resilient surface can be either smooth or also contain a multiplicity of protuberances and/or depressions which cooperate with the rigid surfaced patterned roll. Commonly, rigid rolls are formed with a steel body which is either directly engraved upon or which can contain a hard rubber-covered, or other suitable polymer, surface (directly coated or sleeved) upon which the embossing pattern is formed by any convenient method such as, for example, being laser engraved. The resilient roll may consist of a steel core provided with a resilient surface, such as being directly covered or sleeved with a resilient material such as rubber, or other suitable polymer. The rubber coating may be either smooth or engraved with a pattern. The pattern on the resilient roll may be either a mated or a non-mated pattern with respect to the pattern carried on the rigid roll.

In the rigid-to-rigid embossing process, a single-ply or multi-ply substrate is passed through a nip formed between two substantially rigid rolls. The surfaces of both rolls contain the pattern to be embossed as a multiplicity of protuberances and/or depressions arranged into an aesthetically-pleasing manner where the protuberances and/or depressions in the second roll cooperate with those patterned in the first rigid roll. The first rigid roll may be formed, for example, with a steel body which is either directly engraved upon or which can contain a hard rubber-covered, or other suitable polymer, surface (directly coated or sleeved) upon which the embossing pattern is engraved by any conventional method, such as by laser engraving. The second rigid roll can be formed with a steel body or can contain a hard rubber-covered, or other suitable polymer, surface (directly coated or sleeved) upon which any convenient pattern, such as a matching or mated pattern, is conventionally engraved or laser-engraved.

When substantially rectangular embossing elements have been employed in perforate embossing, the embossing elements on the embossing rolls have generally been oriented so that the long direction axis, i.e., the major axis, of the elements is in the machine direction. That is, the major axis of the elements is oriented to correspond to the direction of the running web being embossed. These elements are referred to as machine direction elements. As a result, the elements produce perforations which extend primarily in the machine direction and undesirably decrease the strength of the web in the cross-machine direction. This orientation improves absorbency and softness, but can degrade, i.e., reduce the strength of, the web primarily in the cross-machine direction while less significantly degrading the strength of the web in the machine direction. As a result, the tensile strength of the web in the cross-machine direction is reduced relatively more, on a percentage basis, than that of the machine direction. In addition, the cross-machine direction strength of the base sheet is typically less than that of the machine direction strength. As a result, by embossing with machine direction elements, the cross-machine direction strength is even further weakened and, accordingly, because the finished product will fail in the weakest direction, the product will be more likely to fail when stressed in the cross-machine direction. Often, it is desired that the web be "square," i.e., have a machine direction/cross-machine direction tensile ratio close to 1.0.

Cross-machine direction tensile strength can be associated with consumer preference for paper toweling. In particular, consumers prefer a strong towel, of which cross-machine direction and machine direction strength are two components. Because the un-embossed base sheet is typically much stronger in the machine direction than the cross-machine direction, a process is desired which results in both improved absorbency and softness without sustaining excessive losses in cross-machine direction tensile strength.

U.S. patent application Ser. No. 10/236,993, which is incorporated herein by reference in its entirety, provides one solution to the above described problem by providing at least two perforate embossing rolls, wherein at least a portion of the elements are oriented to provide perforating nips which are substantially in the cross-machine direction and are configured to perforate the web, thereby allowing relatively greater degradation, i.e., a reduction of strength, of the web in the machine direction while preserving more of the cross-machine direction strength.

Consumers' preferences vary, however, depending upon the use of the final paper product. As such, a single web line may be used to make a variety of paper products, requiring various embossing patterns that effect the ultimate appearance, feel, flexibility, or absorbency of the paper product. Thus, it is often desired to change the embossing pattern to meet these preferences.

Prior art embossing systems are limited in their ability to modify the embossing pattern. Specifically, prior art systems are limited in their ability to modify the directional properties of the embossing rolls. Generally, to change the pattern, a new engraved roll must be obtained for each set of directional properties desired. Installation of a new roll requires that the converting operation be shut down for a time sufficient to complete the roll change. The amount of time that the converting line must be shut down can have a significant impact on productivity, and thereby cost. Thus, where frequent pattern changes are desired, the cost associated with the changes can be substantial.

The present invention addresses these problems by providing at least two embossing rolls, where the embossing rolls may have separate patterns of embossing elements, wherein the embossing pattern of at least one of the rolls is substantially oriented in the cross-machine direction, thereby allowing degradation of the web in the machine direction. Moreover, the invention further addresses the above problems by increasing the ability to further refine the embossing pattern. In particular, the directional properties of the embossing pattern can be changed by shifting the phase of the rolls with respect to each other and/or shifting the rolls along their axes of rotation, thereby providing a variety of patterns that can be produced using the same rolls.

Further advantages of the invention will be set forth in part in the description which follows and in part will be apparent from the description or may be learned by practice of the invention. The advantages of the invention may be realized and attained by means of the instrumentalities and combinations particularly pointed out in the appended claims.

As embodied and broadly described herein, the invention includes an embossing stack of at least two embossing rolls, the embossing rolls defining at least one nip through which a paper web to be embossed is passed. While each of the embossing rolls can have identical embossing element patterns, the rolls may have different embossing element patterns. Moreover, at least one of the embossing rolls may have embossing elements where the longer direction axis of at least a portion of the embossing elements is substantially oriented in the cross-machine direction.

In one embodiment, the invention includes an embossing unit comprising a first embossing roll having male elements and a second embossing roll having male elements, where the first and second embossing rolls define a nip, and where at least one of the first or second embossing rolls has at least a portion of the embossing elements that are substantially oriented in the cross-machine direction. In this embodiment both of the embossing rolls can have at least a portion of the embossing elements substantially oriented in the cross-machine direction.

In another embodiment, the invention includes an embossing unit comprising three embossing rolls, where each of the embossing rolls have male embossing elements. In this embodiment, a first nip is defined between the first and second embossing rolls and a second nip is defined between the second and third embossing rolls. At least a portion of the embossing elements of at least two of the embossing rolls may be substantially oriented in the cross-machine direction.

The invention further contemplates a method of embossing a web comprising passing a web through an embossing unit, where the embossing unit comprises a first embossing roll and a second embossing roll, each of the embossing rolls having male embossing elements. Moreover, at least one of the embossing rolls may have at least a portion of its embossing elements substantially oriented in the cross-machine direction. The first and second rolls define a nip for receiving the web.

In another embodiment of the method of this invention, the web is embossed by passing the web through an embossing unit having first, second, and third embossing rolls, where the first and second embossing rolls define a first nip, and the second and third embossing rolls define a second nip. Each of the embossing rolls may have male elements, and at least one of the embossing rolls may have at least a portion of its male elements substantially oriented in the cross-machine direction.

The accompanying drawings, which are incorporated herein and constitute a part of this specification, illustrate an embodiment of the invention, and, together with the description, serve to explain the principles of the invention.

DESCRIPTION OF THE EMBODIMENTS

Figure 1A:
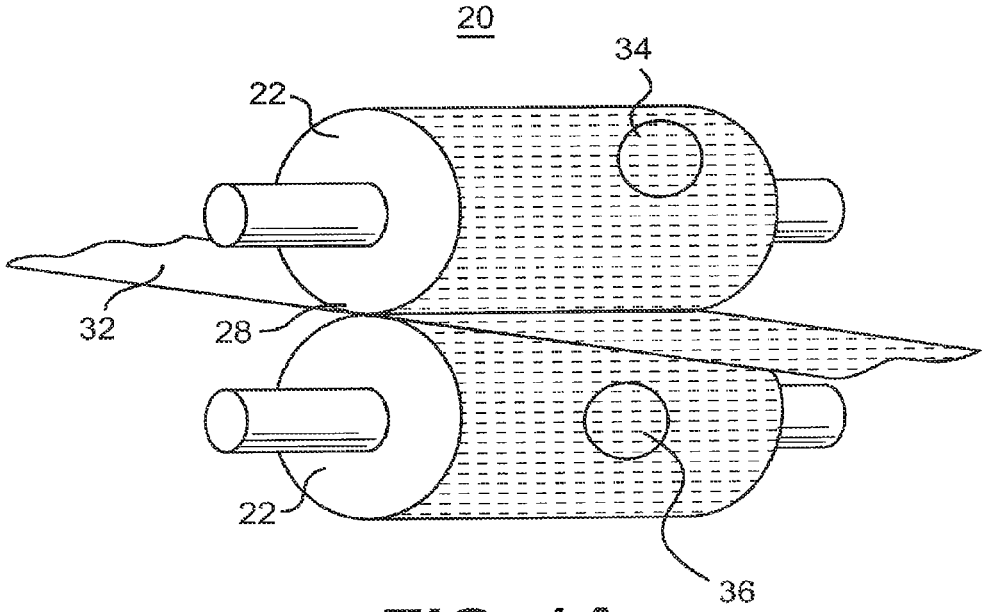
FIGS. 1A-1D illustrate embossing rolls having cross-machine direction elements according to an embodiment of the present invention.
Figure 1B:
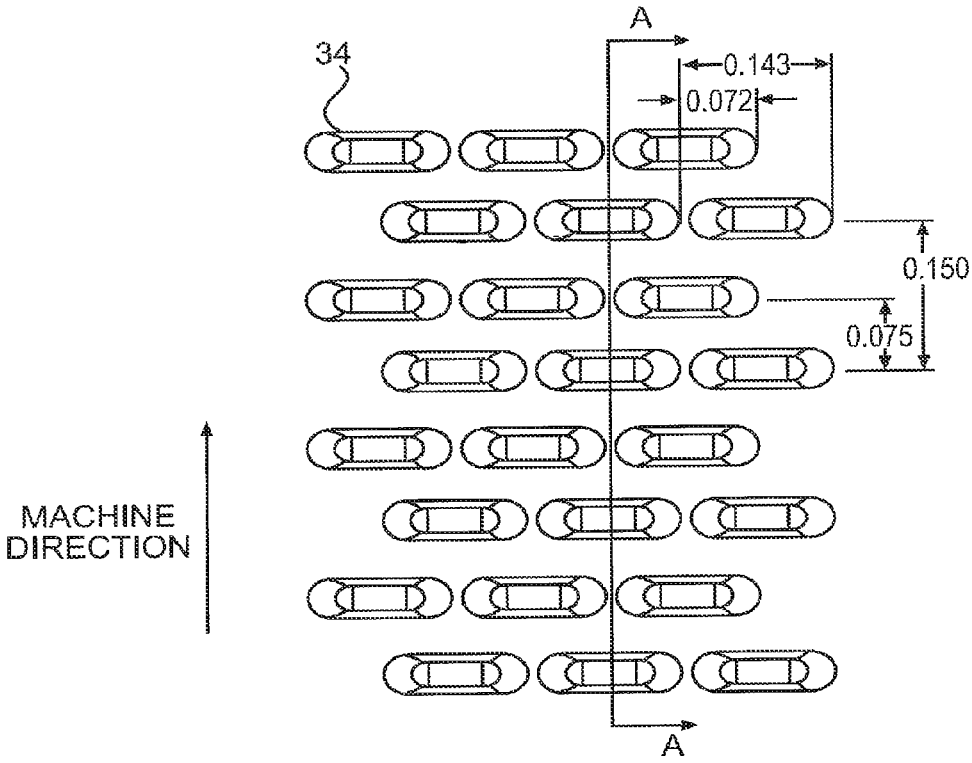
Figure 1C:
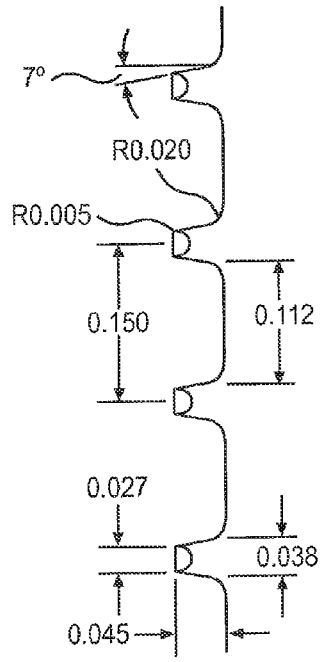
Figure 1D:
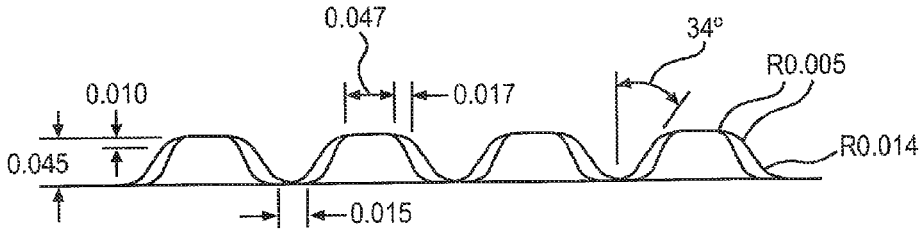

Reference will now be made in detail to embodiments of the present invention, examples of which are illustrated in the accompanying drawings.

The present invention can be used to emboss a variety of types of wet-laid cellulosic webs including paper, and the like. The webs can be continuous or of a fixed length. Moreover, embossed webs can be used to produce any art recognized product, including, but not limited to, paper towels, napkins, tissue, or the like. Moreover, the resulting product can be a single ply or a multi-ply paper product, or a laminated paper product having multiple plies. In addition, the present invention can be used with a web made from virgin furnish, recycled furnish, or a web containing both virgin and recycled furnish, synthetic fibers, or any combination thereof.

In one embodiment, the fibers used to form the web of the present invention include thermally bondable fibers. The thermally bondable fibers may have both a bondable portion to allow thermal bonding of the web structure and a matrix forming portion for providing structure to the web. The thermally bondable fibers for use in the present invention may have been surface modified to impart hydrophilicity thereby allowing the fibers to be dispersed. According to one embodiment of the present invention, the surface modification allows the thermally bondable fibers to be dispersed substantially uniformly throughout the paper product. The fibers can be produced in any art recognized arrangement of the bondable portion and the matrix forming portion. Appropriate configurations include, but are not limited to, a core/sheath arrangement and a side by side arrangement. Thermally bondable fibers for use according to the present invention can be formed from any thermoplastic material. The thermally bondable fibers can be selected from bicomponent fibers, tricomponent fibers, or other multi-component fibers. Bicomponent and tricomponent fibers for use according to the present invention include any art recognized bicomponent or tricomponent fibers. Thermally bondable fibers for use in the present invention may have at least one matrix forming material that does not melt at temperatures to which the product will be subjected. According to an embodiment of the present invention, the matrix forming material does not melt at a temperature of less than about 360° F. According to another embodiment of the present invention, the fibers have at least one matrix forming material that melt at temperatures of not less than about 400° F. In yet another embodiment, the thermally bondable fibers for use in the present invention have at least one matrix forming material that does not melt at a temperature of less than about 450° F. Bicomponent fibers, tricomponent fibers, or other multi-component fibers for use with the present invention are more fully described in U.S. patent application Ser. No. 10/676,017, which is incorporated herein by reference in its entirety.

In accordance with the invention, as broadly described, the converting process of the paper machine may include an embossing unit of at least two embossing rolls, the embossing rolls defining at least one nip through which a paper web to be embossed is passed. While each of the embossing rolls can have identical embossing element patterns, the rolls may have different embossing element patterns. Moreover, at least one of the rolls may have embossing elements where the long direction axis of the embossing elements is substantially oriented in the cross-machine direction. As the web is passed through the nip, an embossing pattern is imparted on the web. Because each of the rolls has an embossing pattern, the embossing pattern imparted by the rolls can be changed to more precisely meet consumer preferences by adjusting the phase of one roll with respect to another roll. Moreover, the embossing pattern can be further changed by shifting one of the rolls along its axis of rotation. This shifting can take place with or without adjusting the phase of the roll, thereby further increasing embossing pattern flexibility. And, these variations can be affected without the expense of making additional embossing rolls or the down time and expense of changing embossing rolls.

Figure 2:
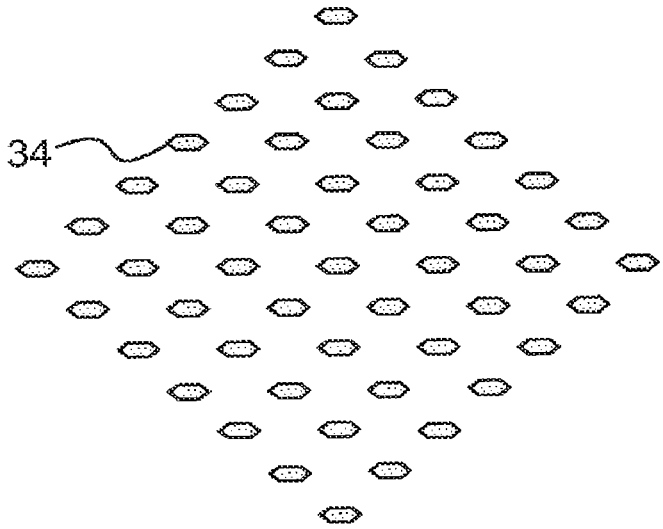
FIG. 2 illustrates a lozenge-shaped cross-machine direction embossing pattern according to an embodiment of the present invention.

In one embodiment of the invention, and as shown in FIG. 1, the converting process includes an embossing unit 20 of two embossing rolls 22, 24 defining a nip 28 through which the web 32 to be embossed is passed. The two embossing rolls 22, 24 may have different embossing patterns. Moreover, each of the embossing patterns may have embossing elements 34, 36 substantially oriented such that the longer direction axis of the elements 34, 36 is in the cross-machine direction, as shown in FIG. 2. While the elements 34, 38 depicted in FIG. 2 are shown as being fully in the cross-machine direction, i.e., 90° from the machine direction, those of ordinary skill in the art will appreciate that the elements 34, 36 may be disposed at an angle of up to about 45° from the cross-machine direction and still be considered cross-machine direction elements and, moreover, will appreciate that a web embossed by elements disposed at an angle of up to about 45° from the cross-machine direction will likewise degrade the machine direction strength of the web.

Figure 3:
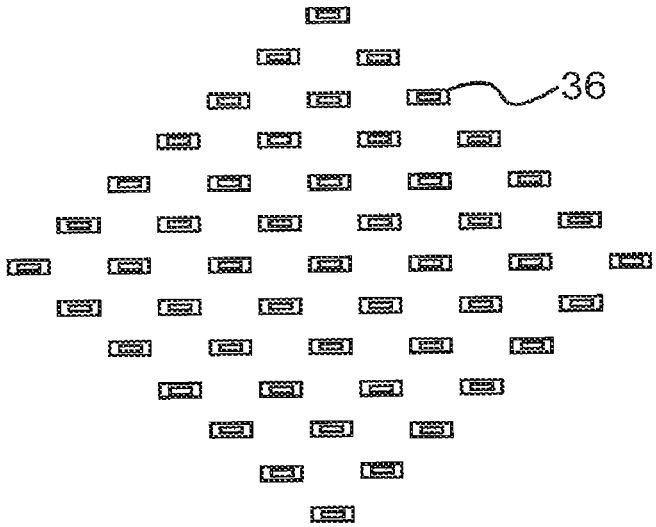
FIG. 3 illustrates a rectangular-shaped cross-machine direction embossing pattern according to an embodiment of the present invention.

In an example of the above embodiment, the first roll 22 may include a pattern of lozenge-shaped male elements 34 aligned in a staggered array as shown in FIG. 2, with the long direction axis of the lozenge-shaped male elements 34 substantially oriented in the cross-machine direction of the web 32 to be embossed. The second roll 24 may include a plurality of interpenetrating rectangular-shaped male elements 36 where the long direction axis of the elements 36 is oriented in the cross-machine direction, as shown in FIG. 3. The rectangular-shaped male elements 36 on the second roll 24 may be aligned with the lozenge-shaped male elements 34 on the first roll 22 so that upon passing through the first nip 28, the web 32 is engaged between the interpenetrating male elements 34, 36 of the first and second rolls 22, 24, respectively. Such an arrangement may produce an embossed pattern on the web 32 similar to that shown in FIG. 4, in which the bosses 38 formed by the lozenge-shaped male elements 34 on first roll 22 are adjacent to and aligned with the debosses 40 formed by interpenetrating male elements 36 on the second roll 24. This alignment degrades the web 32 in the machine direction and may provide increased flexibility and absorbency in the final paper product. In particular, the regions 42 between the bosses 38 and the debosses 40, which lie in the machine direction, are quite heavily worked, thereby breaking down the machine direction strength of the final paper product.

Figure 5:
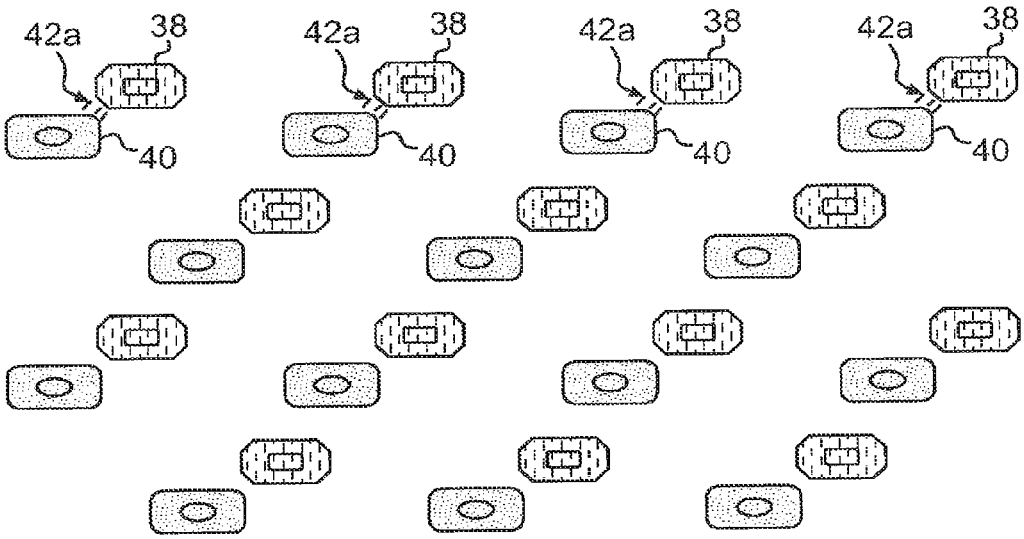
FIG. 5 illustrates a variation of a cross-machine direction embossing pattern imparted to a web according to an embodiment of the present invention.
Figure 6:
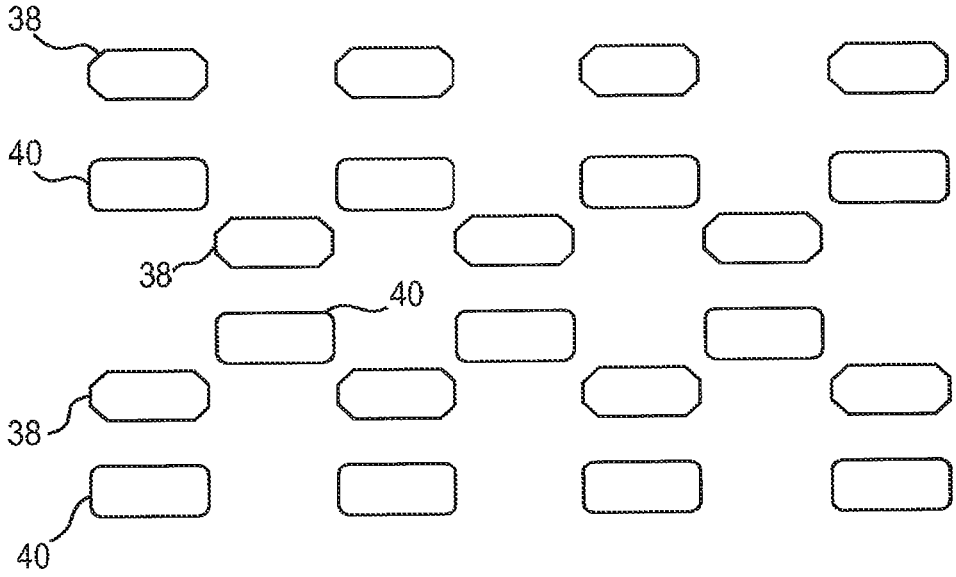
FIG. 6 illustrates another variation of a cross-machine direction embossing pattern imparted to a web according to an embodiment of the present invention.

Further, flexibility in meeting the consumers' requirements may be achieved by the above-described structure. First, by adjusting the degree of interpenetration of the lozenge-shaped male elements 34 on the first roll 22 and the elongated male elements 36 on the second roll 24, the degree to which the region 42 between the bosses 38 and the debosses 40 are worked can be varied. Second, one or more of the embossing rolls can be shifted longitudinally with respect to the other embossing rolls to adjust the step alignment of the embossing elements. And third, one or more of the embossing rolls can be shifted along its axis of rotation to adjust the location and extent of heavily worked regions 42. For example, comparing FIGS. 4 and 6, by shifting roll 24 along its axis of rotation with respect to roll 22, it is possible to adjust the location and extent of heavily worked regions 42. Moreover, comparing FIGS. 4 and 5, it is shown that by adjusting the longitudinal relationship of the rolls with respect to each other, the machine direction length of the heavily worked regions 42 can be varied.

Those of ordinary skill in the art will understand that there are numerous patterns that can be affected by simply shifting the phase and/or axial location of one of the rolls with respect to the other by various degrees. Moreover, the present invention allows for precision in replicating these patterns by allowing repeatable positioning of the rolls for various patterns to within less than 0.25". Thus, when a particular pattern is desired for a product, the rolls can be longitudinally or rotationally shifted to accommodate the desired pattern. Furthermore, those of ordinary skill in the art will likewise understand that a variety of different embossing element shapes can be employed to vary the embossing pattern.

In another embodiment of the present invention, the embossing elements may be patterned to create perforations in the web as it is passed through the nip. Generally, for purposes of this embodiment of the invention, perforations are created when the strength of the web is locally degraded between two bypassing embossing elements resulting in either (1) a macro scale through-aperture or (2) in those cases where a macro scale through-aperture is not present, at least incipient tearing, where such tearing would increase the transmittivity of light through a small region of the web or would decrease the machine direction strength of a web by at least 15% for a given range of embossing depths.

Figure 22A:
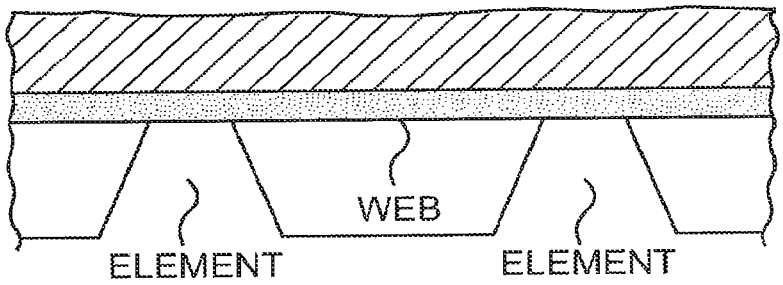
FIGS. 22A-C illustrate the effects of over embossing a web portion in the machine direction and cross-machine direction when using rigid to resilient embossing as compared to perforate embossing a web as in FIG. 17D.
Figure 22B:
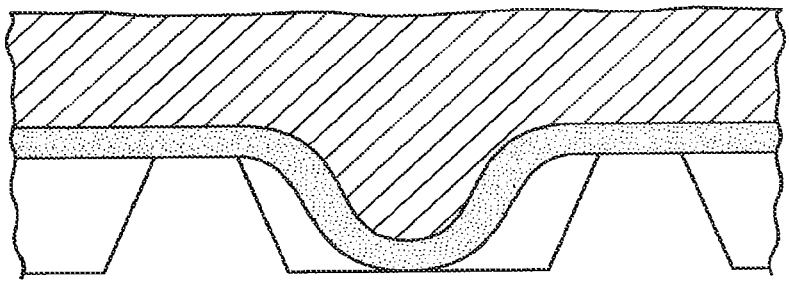
Figure 22C:
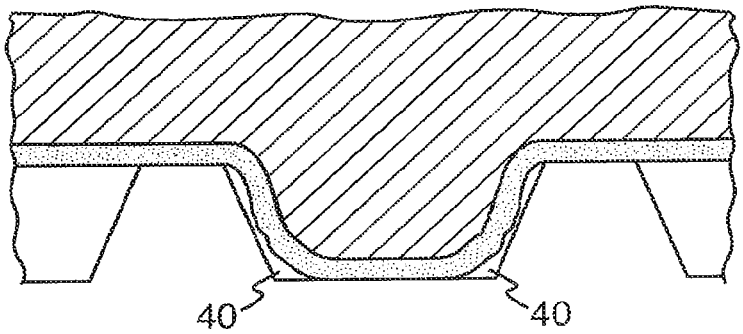

When a web is over-embossed in a rubber to steel configuration, the male steel embossing elements apply pressure to the web and the rubber roll, causing the rubber to deflect away from the pressure, while the rubber also pushes back. As the male embossing elements roll across the rubber roll during the embossing process, the male elements press the web into the rubber roll which causes tension in the web at the area of the web located at the top edges of the deflected rubber roll, i.e., at the areas at the base of the male embossing elements. When the web is over-embossed, tearing can occur at these high-tension areas. More particularly, FIGS. 22A-C depict rubber to steel embossing of a web at various embossing depths. FIG. 22A depicts embossing of a web at approximately 0 mils. In this configuration the rubber roll pins the web at the points where the web contacts the steel roll element tops. Typically no tearing will occur in this configuration. In FIG. 22B, where the embossing depth is approximately the height of the steel embossing element, the web is pinned at the element tops and at a point between the bases of the adjacent steel elements. As with the configuration depicted in FIG. 22A, tearing does not typically occur in this configuration for conventional embossing procedures. FIG. 22C depicts an embossing depth comparable to or greater than the height of the steel element. In this configuration, the "free span" of the web, i.e., the sections of the web that are not pinned between the rubber and steel rolls, becomes shorter as the rubber material fills the area between the adjacent elements. When web rupturing occurs, it tends to occur near the last location where web movement is possible; that is, the area of degradation 40 is the last area that is filled by the rubber material, namely the corners where the bases of the elements meet the surface of the emboss roll.

Figure 22D:
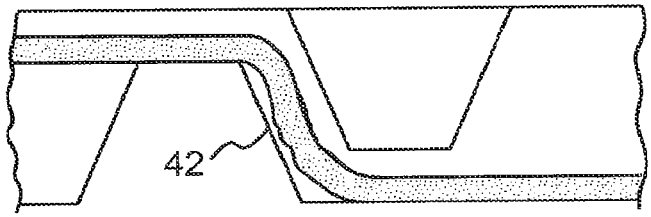

When a web is perforate embossed, on the other hand, the areas of degradation 42, as shown in FIG. 22D, are located along the sides of the perforate embossing element. For clarity, only one pair of cooperating elements are being shown in FIG. 22D. It appears that as a result of this difference the degradation of the web and the resultant reduction of web strength is dramatically different.

In one embodiment according to the present invention, the embossing rolls have substantially identical embossing element patterns, with at least a portion of the embossing elements configured such that they are capable of producing perforating nips which are capable of perforating the web. As the web is passed through the nip, an embossing pattern is imparted on the web. The embossing rolls may be either steel, hard rubber or other suitable polymer, or any material known to one of ordinary skill in the art for use as an embossing roll. The direction of the web as it passes through the nip is referred to as the machine direction. The transverse direction of the web that spans the emboss roll is referred to as the cross-machine direction. In one embodiment, a predominant number, i.e., at least 50% or more, of the perforations are configured to be oriented such that the major axis of the perforation is substantially oriented in the cross-machine direction. An embossing element is substantially oriented in the cross-machine direction when the long axis of the perforation nip formed by the embossing element is at an angle of from about 60° to 120° from the machine direction of the web.

According to one embodiment of the present invention, the embossing rolls 22, 24 are matched (i.e., substantially similar, or at least close to, identical male) embossing rolls. The embossing rolls 22, 24 may be configured to create perforations such that the perforations created by the embossing elements 34 are oriented such that the major axis of the perforations extend in the cross-machine direction, i.e., the elements are in the cross-machine direction, although it is possible to envisage configurations in which perforations extending in the cross-machine direction are formed by elements which are longer in the machine direction, such a configuration would normally be sub-optimal as it would compromise the overall number of perforations which could be formed in the web. Accordingly, when we discuss elements oriented in the cross-machine direction, we are referring to FINNEGAN elements that are configured such that the orientation of the perforation formed by those elements extends in the cross-machine direction, irrespective of the shape of the remainder of the element not contributing to the shape of the nip. While the embossing rolls 22, 24 can also have embossing elements oriented such that the major axis of the elements is in the machine direction, a predominant number, i.e., at least 50% or more, of the elements 34 should be oriented such that they are capable of producing perforating nips extending in the cross-machine direction. In another embodiment, substantially all, i.e., at least more than 75%, of the elements 34 are oriented such that they are capable of producing perforating nips extending in the cross-machine direction. In yet another embodiment, substantially all of the elements are oriented in the cross-machine direction. Moreover, at least about 25% of the cross-machine direction elements may be perforating elements. In one embodiment, substantially all of the cross-machine direction elements are perforating elements. Thus, when the web passes through the embossing rolls 22, 24 at least a portion of the cross-machine direction elements are aligned such that the web is perforated such that at least a portion of the perforations are substantially oriented in the cross-machine direction.

The end product characteristics of a cross-machine direction perforate or non-perforate embossed product can depend upon a variety of factors of the embossing elements that are imparting a pattern on the web. These factors can include one or more of the following: embossing element height, angle, shape, including sidewall angle, spacing, engagement, and alignment, as well as the physical properties of the rolls, base sheet, and other factors. Following is a discussion of a number of these factors.

An individual embossing element 34 has certain physical properties, such as height, angle, and shape, that affect the embossing pattern during an embossing process. The embossing element can be either a male embossing element or a female embossing element. The height of an element 34 is the distance the element 34 protrudes from the surface of the embossing roll 22, 24. The embossing elements 34 may have a height of at least about 15 mils. In one embodiment according to the present invention, the cross-machine direction elements 34 have a height of at least about 30 mils. In another embodiment of the present invention, the cross-machine direction elements 34 have a height of greater than about 45 mils. In yet another embodiment of the invention, the cross-machine elements have a height of greater than about 60 mils. In yet another embodiment, a plurality of the elements 34 on the roll have at least two regions having a first region having elements having a first height and at least a second region having elements having a second height. In one embodiment, the elements 34 have a height of between about 30 to 65 mils. Those of ordinary skill in the art will understand that there are a variety of element heights that can be used, depending upon a variety of factors, such as the type of web being embossed and the desired end product.

The angle of the cross-machine direction elements 34 substantially defines the direction of the degradation of the web due to cross-machine perforate embossing. When the elements 34 are oriented at an angle of about 90° from the machine direction, i.e., in the absolute cross-machine direction, the perforation of the web can be substantially in the direction of about 90° from the machine direction and, thus, the degradation of web strength is substantially in the machine direction. On the other hand, when the elements 34 are oriented at an angle from the absolute cross-machine direction, degradation of strength in the machine direction will be less and degradation of strength in the cross-machine direction will be more as compared to a system where the elements 34 are in the absolute cross-machine direction.

The angle of the elements 34 can be selected based on the desired properties of the end product. Thus, the selected angle can be any angle that results in the desired end product. In an embodiment according to the present invention, the cross-machine direction elements 34 can be oriented at an angle of at least about 60° from the machine direction of the web and less than about 120° from the machine direction of the web. In another embodiment, the cross-machine direction elements 34 are oriented at an angle from at least about 75° from the machine direction of the web and less than about 105° from the machine direction of the web. In yet another embodiment, the cross-machine direction elements 34 are oriented at an angle from at least about 80° from the machine direction of the web and less than about 100° from the machine direction of the web. In still yet another embodiment, the cross-machine direction elements 34 are oriented at an angle of about 85-95° from the machine direction.

Figure 7:
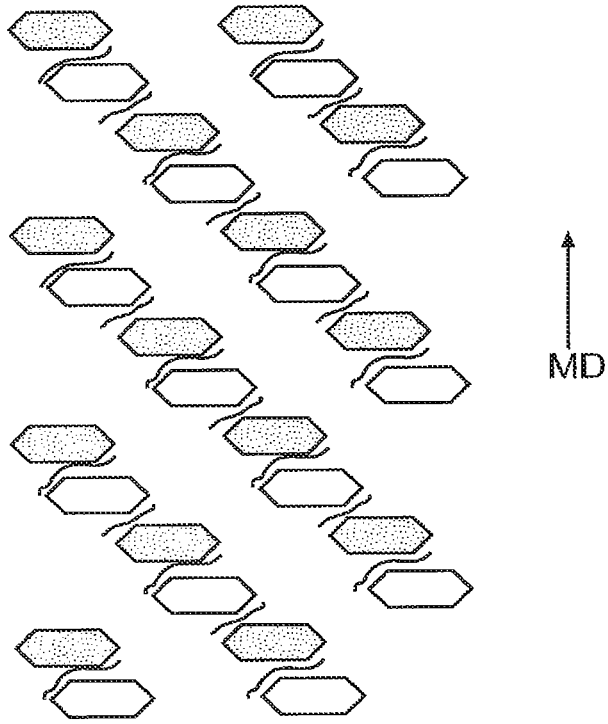
FIG. 7 illustrates cross-machine direction elements according to another embodiment of the present invention.
Figure 8:
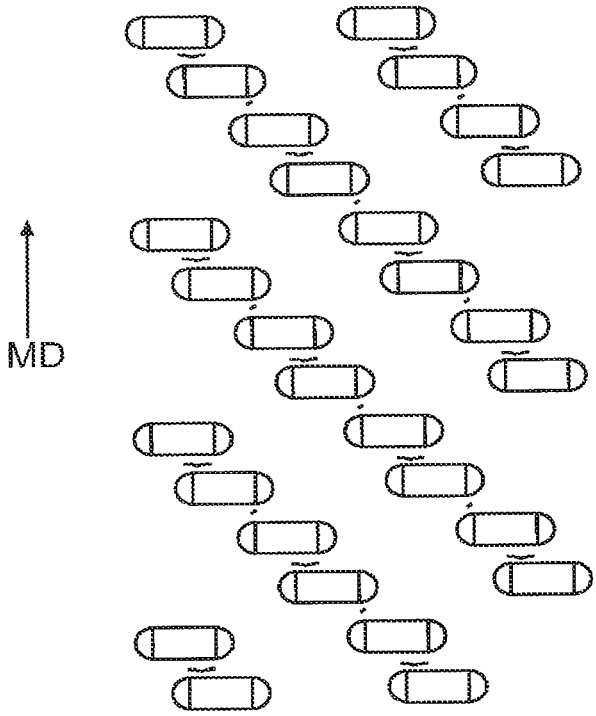
FIG. 8 illustrates cross-machine direction elements according to another embodiment of the present invention.

A variety of element shapes can be successfully used in the present invention. The element shape is the "footprint" of the top surface of the element, as well as the side profile of the element. The elements 34 may have a length (in the cross-machine direction)/width (in the machine direction) (L/W) aspect ratio of at least greater than 1.0, however while noted above as sub-optimal, the elements 34 can have an aspect ratio of less than 1.0. In one embodiment the aspect ratio may is about 2.0. In addition to those shapes previously described, one element shape that can be used in this invention is a hexagonal element, as depicted in FIG. 7. Another element shape, termed an oval, is depicted in FIG. 8. For oval elements, the ends may have radii of at least about 0.003" and less than about 0.030" for at least the side of the element adjacent to an interpenetrating element. In one embodiment, the end radii are about 0.0135". Those of ordinary skill in the art will understand that a variety of different embossing element shapes, such as rectangular, can be employed to vary the embossing pattern.

In one embodiment, at least a portion of the elements 34 are beveled. In particular, in one embodiment the ends of a portion of the elements 34 are beveled. Oval elements with beveled edges are depicted in FIG. 1. By beveling the edges, the disruptions caused by the embossing elements can be better directed in the cross-machine direction, thereby reducing cross-machine direction degradation caused by the unintentional machine direction disruptions. The bevel dimensions can be from at least about 0.010" to at least about 0.025" long in the cross-machine direction and from at least about 0.005" to at least about 0.015" in the z-direction. Other elements, such as hexagonal, rectangular, or lozenge-shaped elements, can be beveled, as well.

According to one embodiment of the present invention, the cross-machine direction sidewalls of the elements 34 are angled. As such, when the cross-machine direction sidewalls are angled, the base of the element 34 has a width that is larger than that of the top of the element. In one embodiment, the cross-machine direction sidewall angle be less than about 20°. In another embodiment, the cross-machine direction sidewall angle be less than about 17°. In yet another embodiment, the cross-machine direction sidewall angle be less than about 14°. Finally, in still yet another embodiment, the cross-machine direction sidewall angle is less than about 11°.

When the opposing elements 34 of the embossing rolls are engaged with each other during an embossing process, the effect on the web is impacted by at least element spacing, engagement, and alignment. When perforate embossing is desired, the elements 34 are spaced such that the clearance between the sidewalls of elements of a pair, i.e., one element 34 from each of the opposing embossing rolls 22, 24 creates a nip that perforates the web as it is passed though the embossing rolls 22, 24. If the clearance between the elements 34 on opposing rolls is too great, the desired perforation of the web may not occur. On the other hand, if the clearance between the elements 34 is too little, the physical properties of the finished product may be degraded excessively or the embossing elements themselves could be damaged. The required level of engagement of the embossing rolls is at least a function of the embossing pattern (element array, sidewall angle, and element height), and the base sheet properties, e.g., basis weight, caliper, strength, and stretch. At a minimum, the clearances between the sidewalls of the opposing elements of the element pair should be sufficient to avoid interference between the elements. In one embodiment, the minimum clearance is about a large fraction of the thickness of the base sheet. For example, if a conventional wet press (CWP) base sheet having a thickness of 4 mils is being embossed, the clearance can be at least about 2-3 mils. If the base sheet is formed by a process which results in a web with rather more bulk, such as, for example, a through-air-dried (TAD) method or by use of an undulatory creping blade, the clearance could desirably be relatively less. Those of ordinary skill in the art will be able to determine the desired element spacing of the present invention based on the factors discussed above using the principles and examples discussed further herein.

As noted above, in one embodiment the height of the elements 34 may be at least about 30 mils, and further may be from about 30 to 65 mils. Engagement, as used herein, is the overlap in the z-direction of the elements from opposing embossing rolls when they are engaged to form a perforating nip. The engagement overlap should be at least 1 mil.

Figure 17A:
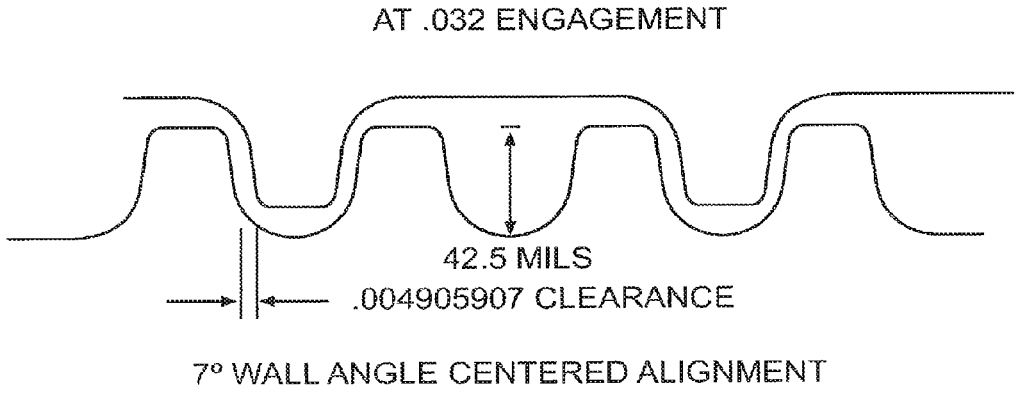
FIGS. 17A-C are side views of the cross-machine direction elements of embodiments of the present invention having differing wall angles and illustrating the effect of the differing wall angles.
Figure 17B:
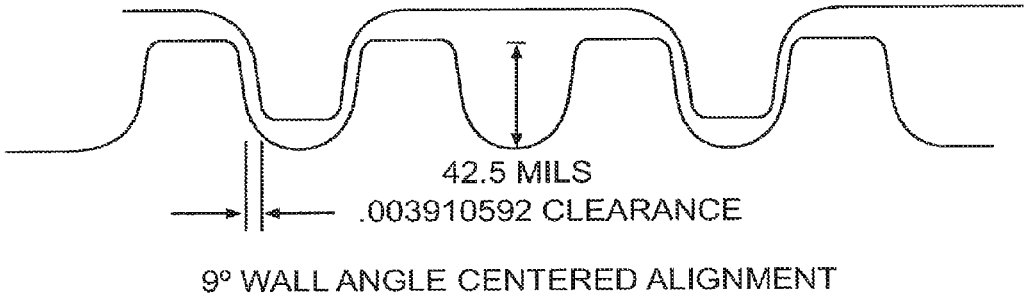
Figure 17C:
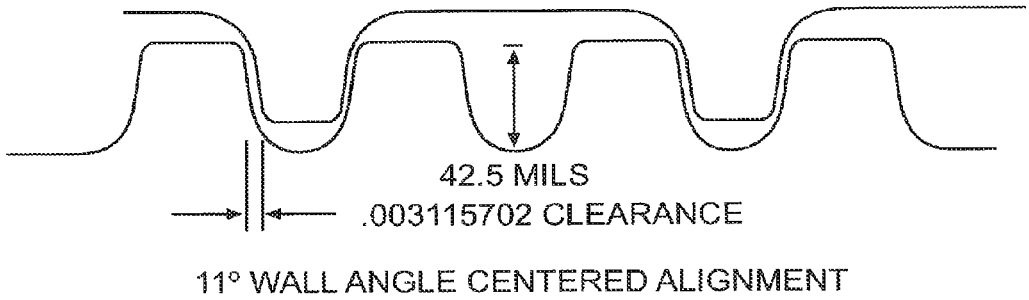
Figure 18A:
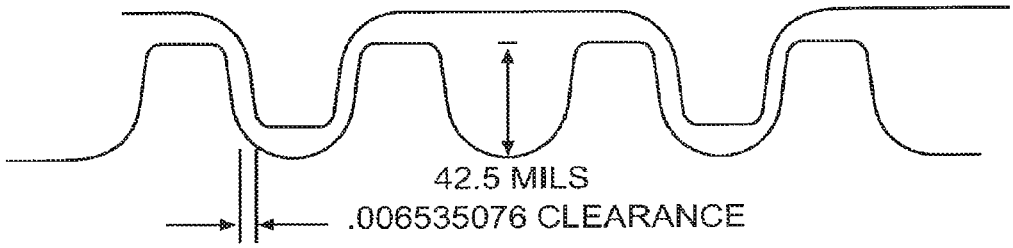
FIGS. 18A-C are side views of the cross-machine direction elements of embodiments of the present invention having differing wall angles and illustrating the effect of the differing wall angles.
Figure 18B:
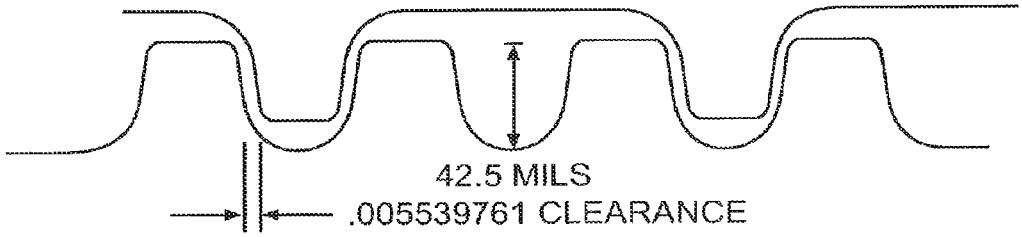
Figure 18C:
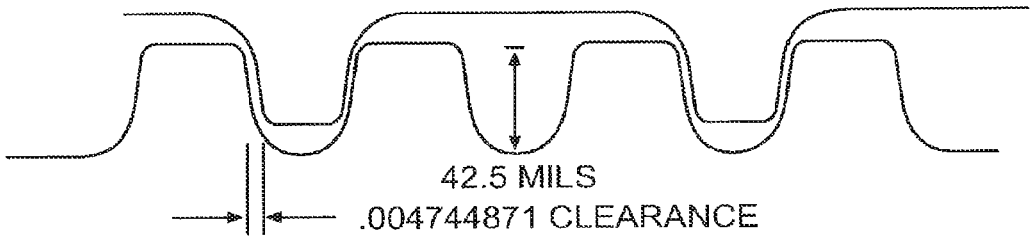
Figure 19A:
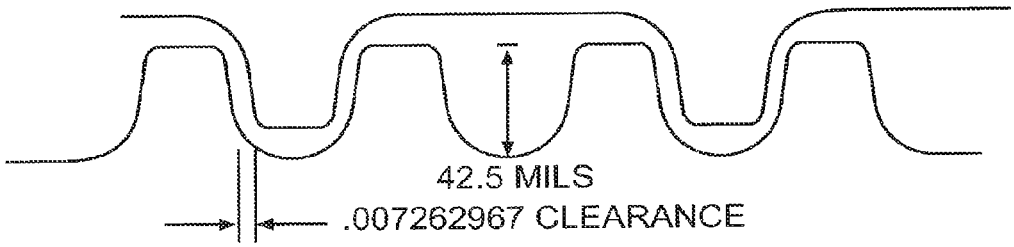
FIGS. 19A-C are side views of the cross-machine direction elements of yet another embodiment of the present invention having differing wall angles and illustrating the effect of the differing wall angles.
Figure 19B:
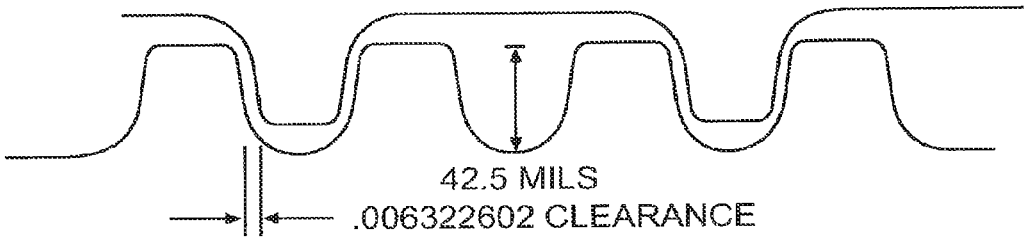
Figure 19C:
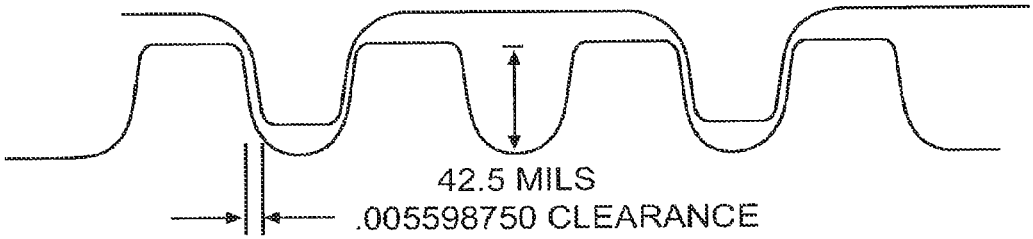

In one embodiment, the engagement is at least about 15 mils. Various engagements are depicted in FIGS. 17-19. In particular, FIG. 17 depicts a 32 mil engagement. That is, the overlap of the elements, in the z-direction, is 32 mils. The desired engagement is determined by a variety of factors, including element height, element sidewall angle, element spacing, desired effect of the embossing elements on the base sheet, and the base sheet properties, e.g., basis weight, caliper, strength, and stretch. Those of ordinary skill in the art will understand that a variety of engagements can be employed based on the above, as well as other factors. The engagement may be chosen to substantially degrade the machine direction tensile strength of the web. The engagement may be at least about 5 mils.

In one embodiment, where the element height is about 42.5 mils and the elements have sidewall angles of from about 7° to 11°, the engagement range can be from about 16 to 32 mils. FIG. 17 depicts a 32 mil engagement, where the element heights are 42.5 mils and the sidewall angles are 7°, 9°, and 11°. It is believed that lower sidewall angles make the process significantly easier to run with more controllability and decreased tendency to "picking."

Figure 9:
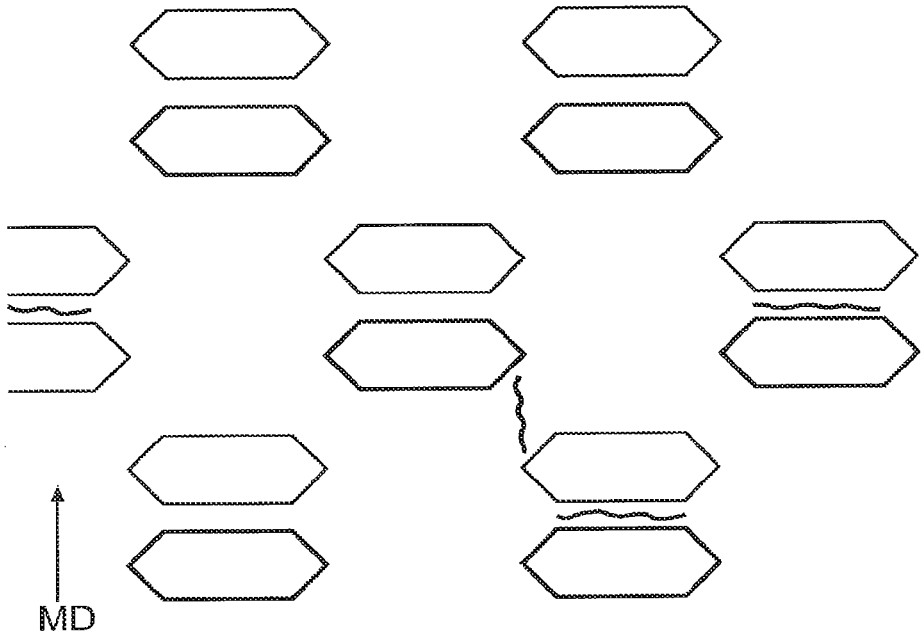
FIG. 9 illustrates the alignment of the cross-machine direction elements according to an embodiment of the present invention.
Figure 10:
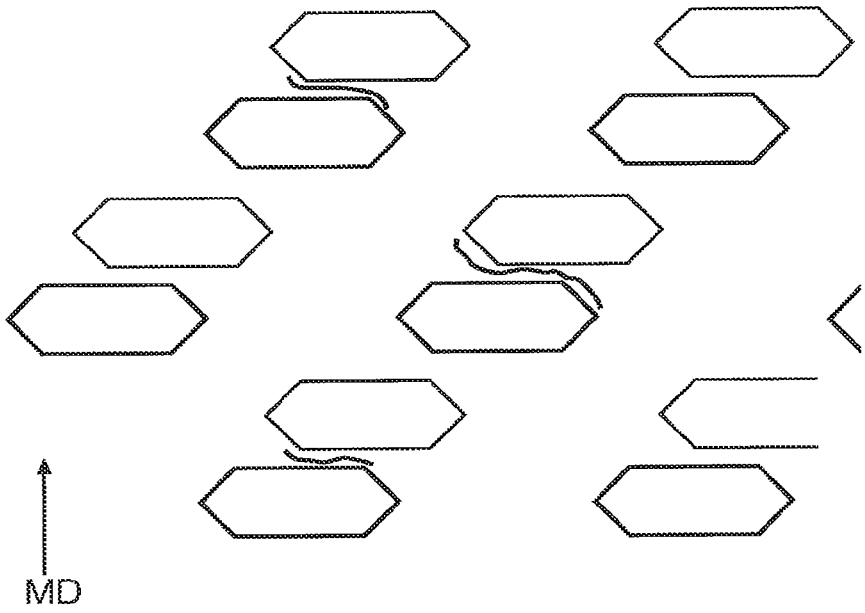
FIG. 10 illustrates the alignment of the cross-machine direction elements according to another embodiment of the present invention.
Figure 11:
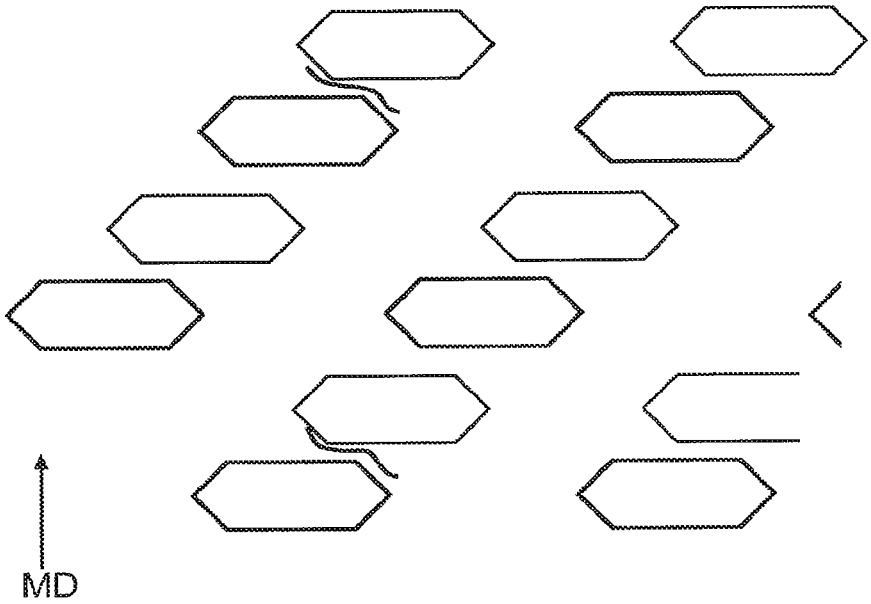
FIG. 11 illustrates the alignment of the cross-machine direction elements according to another embodiment of the present invention.
Figure 12:
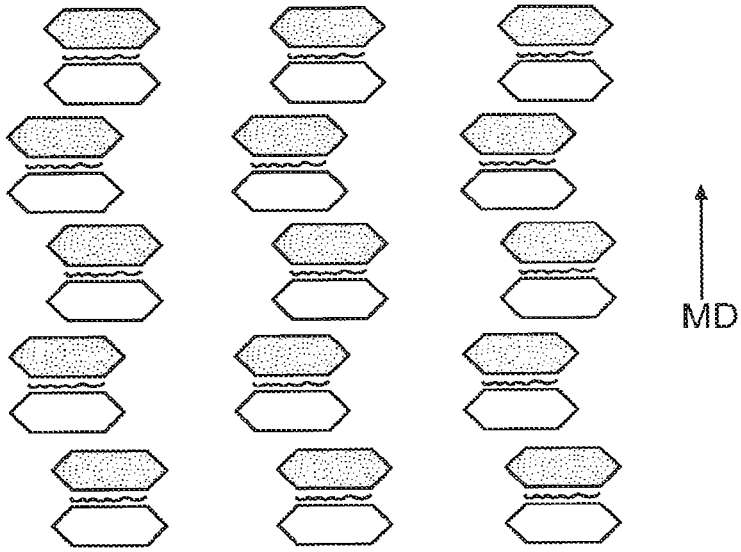
FIG. 12 illustrates the alignment of the cross-machine direction elements according to yet another embodiment of the present invention.

The element alignment also affects the degradation of the web in the machine and cross-machine directions. Element alignment refers to the alignment in the cross-machine direction within the embossing element pairs when the embossing rolls are engaged. FIG. 9 depicts an embodiment including hexagonal embossing elements having a full step alignment, i.e., where the elements are completely overlapped in the cross-machine direction. FIG. 10 depicts an embodiment wherein hexagonal embossing elements are in half step alignment, i.e., where the elements of each element pair are staggered so that half of the engaged portion of their cross-machine direction dimensions overlap. FIG. 11 depicts an embodiment wherein hexagonal embossing elements are in quarter step alignment, i.e., where the elements of each element pair are staggered so that one quarter of the engaged portion of their cross-machine direction dimensions overlap. The embodiment depicted in FIG. 12 is a staggered array, wherein each element pair is in half step alignment with adjacent element pairs. Those of ordinary skill in the art will understand that a variety of element alignments are available for use with this invention, depending upon preferred embossing patterns, web strength requirements, and other factors.

Figure 14:
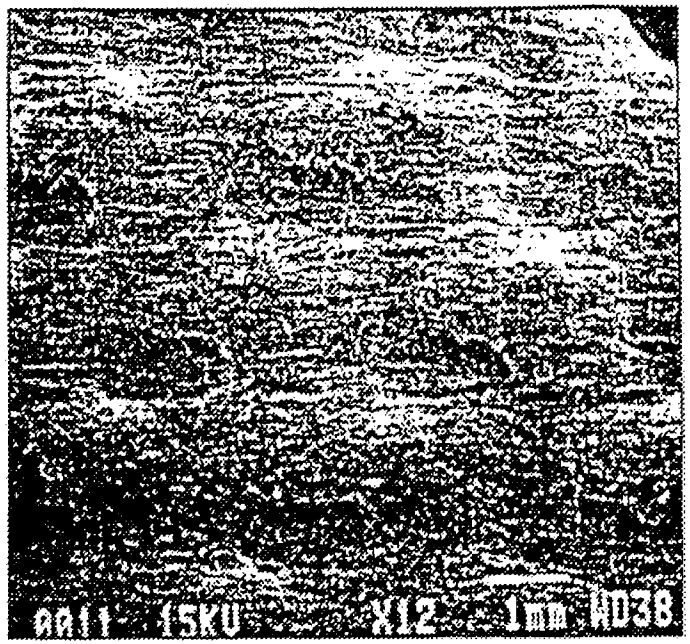
FIG. 14 is a photomicrograph illustrating the effect of cross-machine direction elements on a web according to another embodiment of the present invention.
Figure 13:
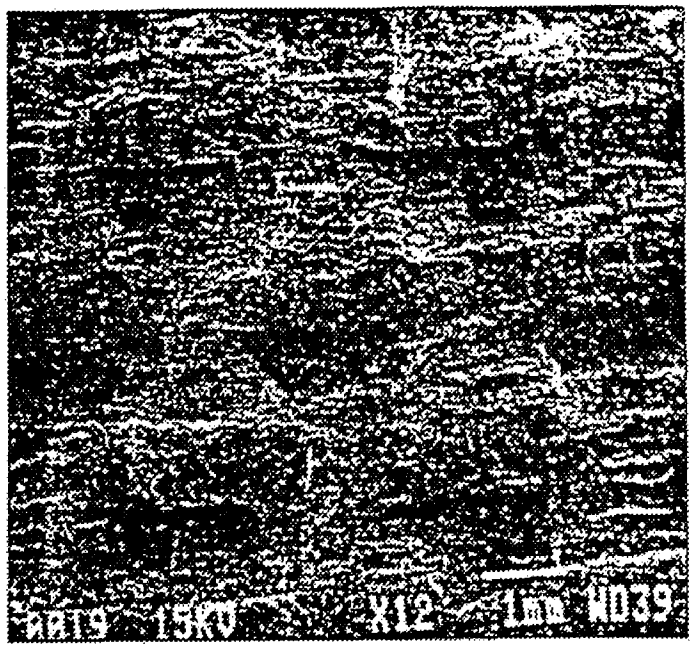
FIG. 13 is a photomicrograph illustrating the effect of cross-machine direction elements on a web according to an embodiment of the present invention.

FIGS. 13-14 depict the effects of various alignments of a hexagonal element arrangement on a perforate embossed web. In the example depicted in FIG. 13, where the elements are in full step alignment, perforations exist only in the cross-machine direction in the area between the element pairs. However, between the pairs of element pairs, occasional machine direction perforations can be caused in the machine direction. The result is a degradation of strength in both the machine and cross-machine directions. In the example depicted in FIG. 14, the web is perforate embossed by element pairs in half step alignment. In this example, the perforations exist primarily in the cross-machine direction, with some minor perforations caused in the machine-direction. Thus, in FIG. 9, machine direction strength is degraded, and cross-machine direction strength is degraded to a lesser extent.

Figure 21A:
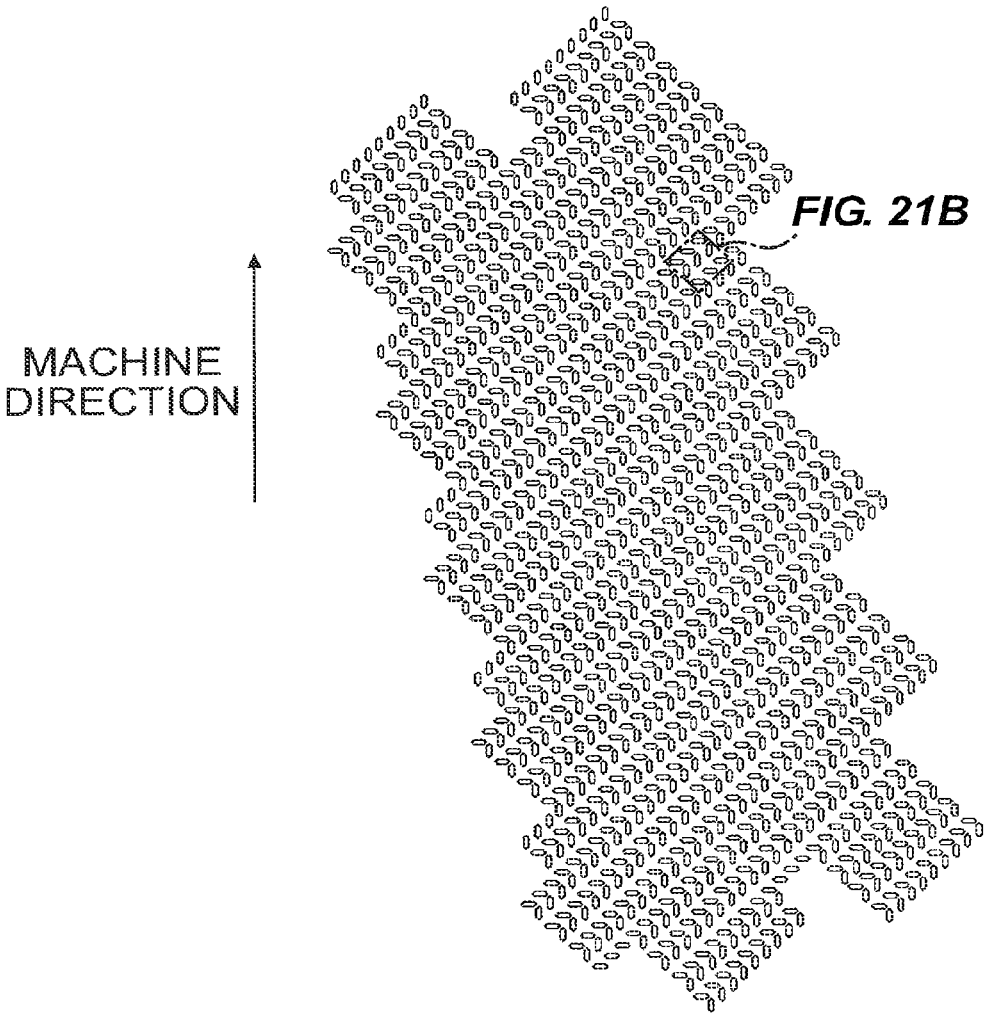
FIGS. 21A-B illustrate embossing rolls having both cross-machine direction and machine direction elements according to an embodiment of the present invention.
Figure 21B:
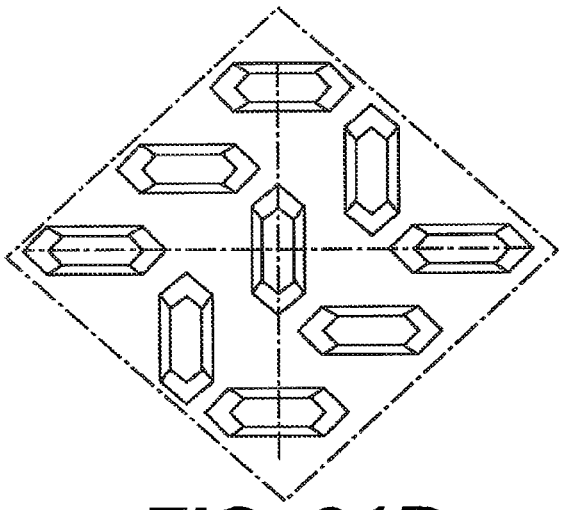

As noted above, the elements can be both in the machine direction and cross-machine direction. FIG. 21 depicts an emboss roll having cross-machine direction and machine direction hexagonal elements.

Figure 15:
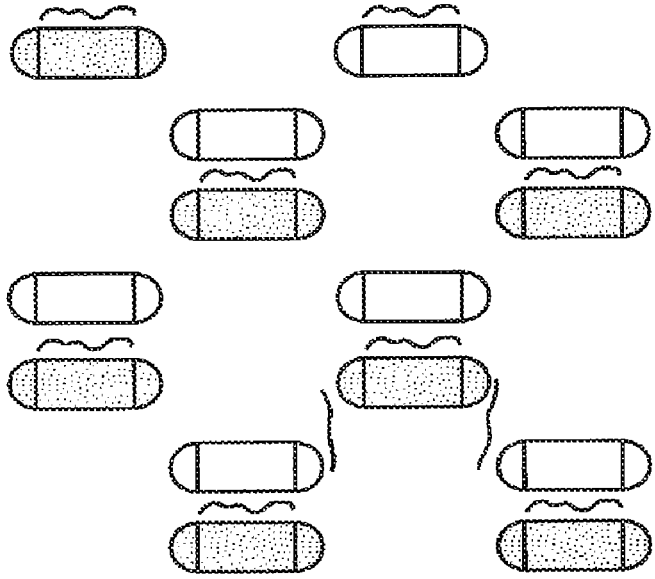
FIG. 15 illustrates the effect of cross-machine direction elements on a web according to yet another embodiment of the present invention.
Figure 16:
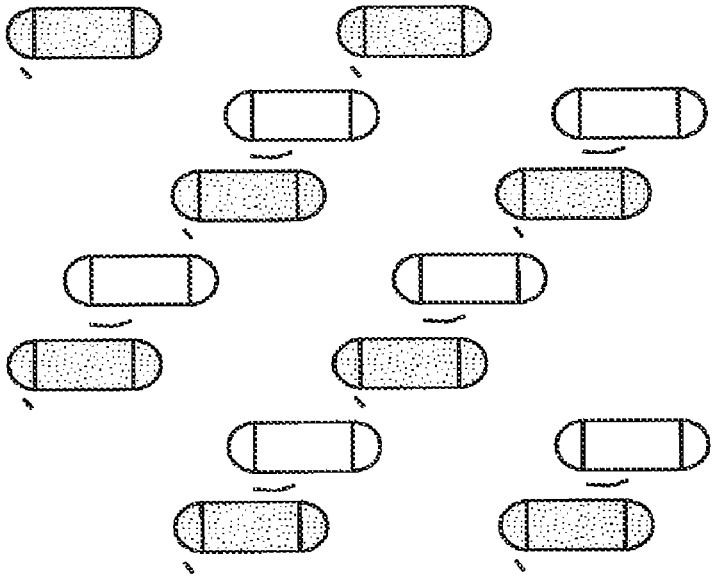
FIG. 16 illustrates the effect of cross-machine direction elements on a web according to yet another embodiment of the present invention.

In another embodiment, depicted in FIG. 15, the web is perforate embossed by beveled oval element pairs in full step alignment. As with the full step hexagonal elements discussed above, in the area between the element pairs perforations exist primarily in the cross-machine direction. However, between the pairs of element pairs, perforations can be caused in the machine direction. The result is a degradation of strength in both the machine and cross-machine directions. In the embodiment depicted in FIG. 16, on the other hand, where the beveled oval elements in a half step alignment are employed to perforate emboss a web, the machine direction perforations are substantially reduced. In particular, between the elements in half step alignment, the perforation lies primarily in the cross-machine direction. Between the element pairs, which are in zero step alignment, primarily pinpoint ruptures exist. These pinpoint ruptures have a minor effect on degradation of the directional properties of the web.

Those of ordinary skill in the art will understand that numerous different configurations of the above described element parameters, i.e., element shape, angle, sidewall angle, spacing, height, engagement, and alignment, can be employed in the present invention in both perforate and non-perforate configurations. The selection of each of these parameters may depend upon the base sheet used, the desired end product, or a variety of other factors.

To establish the effectiveness of the various element patterns when perforating the web in the cross-machine direction, and thereby degrading machine direction strength while maintaining cross-machine direction strength, a test was developed, the transluminance test, to quantify a characteristic of perforated embossed webs that is readily observed with the human eye. A perforated embossed web that is positioned over a light source will exhibit pinpoints of light in transmission when viewed at a low angle and from certain directions. The direction from which the sample should be viewed, e.g., machine direction or cross-machine direction, in order to see the light, is dependent upon the orientation of the embossing elements. Machine direction oriented embossing elements tend to generate machine direction ruptures in the web which can be primarily seen when viewing the web in the cross-machine direction. Cross-machine direction oriented embossing elements, on the other hand, tend to generate cross-machine direction ruptures in the web which can be seen primarily when viewing the web in the machine direction.

Figure 20:
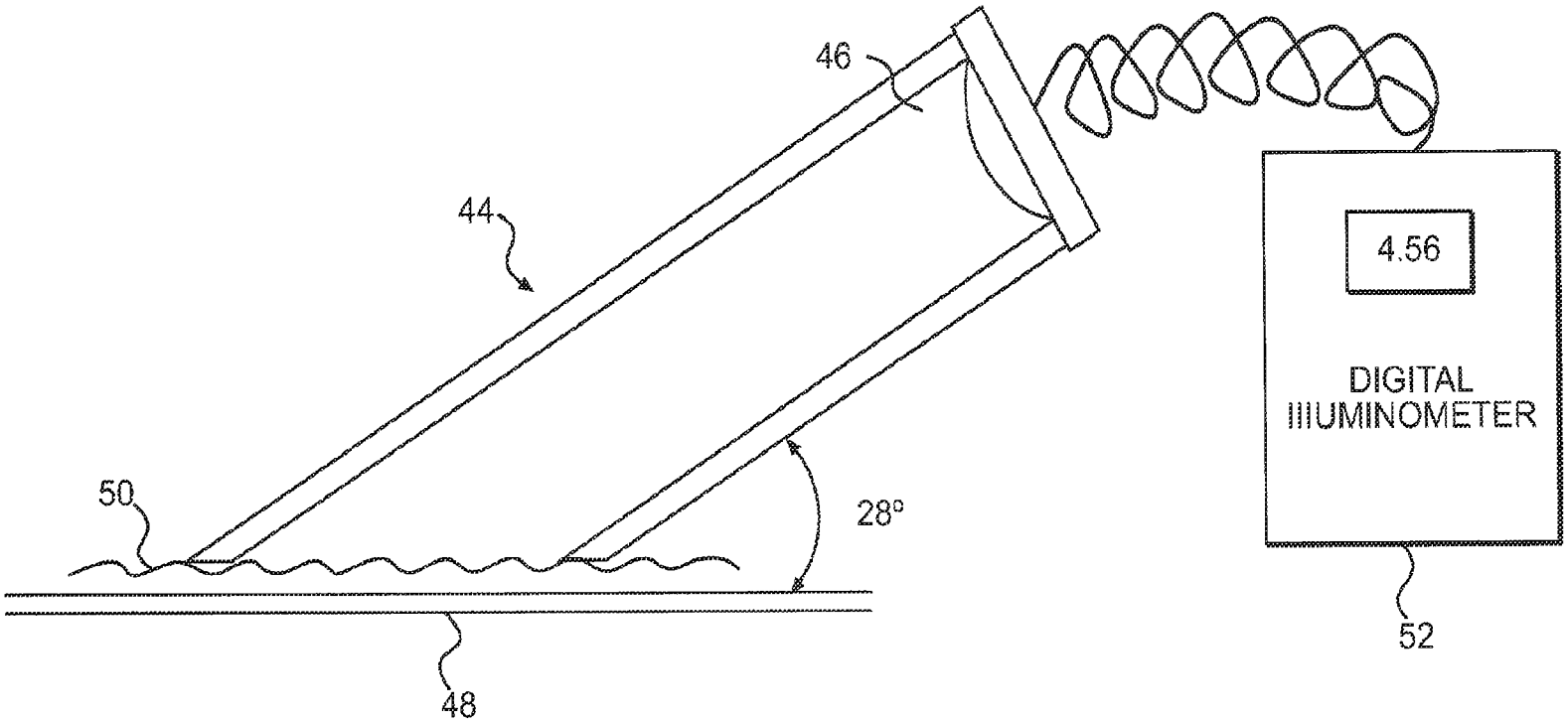
FIG. 20 depicts a transluminance test apparatus.

The transluminance test apparatus, as depicted in FIG. 20, consists of a piece of cylindrical tube 44 that is approximately 8.5" long and cut at a 28° angle. The inside surface of the tube is painted flat black to minimize the reflection noise in the readings. Light transmitted through the web itself, and not through a rupture, is an example of a non-target light source that could contribute to translucency noise which could lead non-perforate embossed webs to have transluminance ratios slightly exceeding 1.0, but typically by no more than about 0.05 points. A detector 46, attached to the non-angled end of the pipe, measures the transluminance of the sample. A light table 48, having a translucent glass surface, is the light source.

The test is performed by placing the sample 50 in the desired orientation on the light table 48. The detector 46 is placed on top of the sample 50 with the long axis of the tube 44 aligned with the axis of the sample 50, either the machine direction or cross-machine direction, that is being measured and the reading on a digital illuminometer 52 is recorded. The sample 50 is turned 90° and the procedure is repeated. This is done two more times until all four views, two in the machine direction and two in the cross-machine direction, are measured. In order to reduce variability, all four measurements are taken on the same area of the sample 50 and the sample 50 is always placed in the same location on the light table 48. To evaluate the transluminance ratio, the two machine direction readings are summed and divided by the sum of the two cross-machine direction readings.

To illustrate the results achieved when perforate embossing with cross-machine direction elements as compared to machine direction elements, a variety of webs were tested according to the above described transluminance test. The results of the test are shown in Table 1.

TABLE 1

Transluminance Ratios

| Basis Weight (lbs/ream) | Creping Method (Blade) | Emboss Alignment | Emboss Pattern | Transluminance Ratio |
|---|---|---|---|---|
| 30 | Undulatory | Full Step | CD Beveled Oval | 1.074 |
| 30 | Undulatory | Half Step | CD Beveled Oval | 1.056 |
| 32 | Undulatory | Half Step | CD Beveled Oval | 1.050 |
| 30 | Undulatory | Half Step | CD Oval | 1.047 |
| 31 | Undulatory | Half Step | CD Oval | 1.044 |
| 31 | Undulatory | Full Step | CD Oval | 1.043 |
| 30 | Undulatory | Full Step | CD Beveled Oval | 1.040 |
| 32 | Undulatory | Half Step | CD Beveled Oval | 1.033 |
| 30 | Undulatory | Half Step | CD Beveled Oval | 1.033 |
| 30 | Undulatory | Full Step | CD Oval | 1.027 |
| 32 | Undulatory | Half Step | CD Beveled Oval | 1.025 |
| 30 | Undulatory | Half Step | CD Oval | 1.022 |
| 31 | Undulatory | Full Step | CD Oval | 1.018 |
| 20 | Undulatory | Half Step | CD Beveled Oval | 1.015 |
| 30 | Undulatory | Half Step | CD Beveled Oval | 1.012 |
| 30 | Undulatory | Full Step | CD Beveled Oval | 1.006 |
| 28 | Standard | Unknown | MD Perforated | 1.000 |
| 24 | Undulatory | Half Step | MD Perforated | 0.988 |
| 22 | Standard | Unknown | MD Perforated | 0.980 |
| 29 | Undulatory | Half Step | MD Perforated | 0.966 |
| 29 | Undulatory | Half Step | MD Perforated | 0.951 |
| 31 | Undulatory | Half Step | MD Perforated | 0.942 |
| 29 | Undulatory | Half Step | MD Perforated | 0.925 |

A transluminance ratio of greater than 1.000 indicates that the majority of the perforations are in the cross-machine direction. For embossing rolls having cross-machine direction elements, the majority of the perforations are in the cross-machine direction. And, for the machine direction perforated webs, the majority of the perforations are in the machine direction. Thus, the transluminance ratio can provide a ready method of indicating the predominant orientation of the perforations in a web.

As noted above, embossing in the cross-machine direction preserves cross-machine direction tensile strength. Thus, based on the desired end product, a web embossed with a cross-machine direction pattern will exhibit one of the following when compared to the same base sheet embossed with a machine direction pattern: (a) a higher cross-machine direction tensile strength at equivalent finished product caliper, or (b) a higher caliper at equivalent finished product cross-machine direction tensile strength.

Furthermore, the tensile ratio (a comparison of the machine direction tensile strength to the cross-machine direction tensile strength—MD strength/CD strength) of the cross-machine embossed web typically will be at or below the tensile ratio of the base sheet, while the tensile ratio of the sheet embossed using prior art machine direction embossing typically will be higher than that of the base sheet. These observations are illustrated by the following examples.

Higher cross-machine direction strength at equivalent caliper is demonstrated in Table 2. This table compares two products perforate embossed from the same base sheet—a 29 pounds per ream (lbs/R), undulatory blade-creped, conventional wet press (CWP) sheet.

TABLE 2

| Increased CD Strength at Equivalent Caliper | | | | | |
|---|---|---|---|---|---|
| Emboss (perforate) | Basis Wt. (lbs/R) | Caliper (mils) | MD Dry Tensile (g/3") | CD Dry Tensile (g/3") | Dry Tensile Ratio (MD/CD) |
| CD Hexagonal | 29.1 | 144 | 3511 | 3039 | 1.16 |
| MD Hexagonal | 29.2 | 140 | 4362 | 1688 | 2.58 |

As shown in Table 2, the cross-machine direction perforate embossed web has approximately the same caliper as the machine direction perforate embossed web (144 vs. 140 mils, respectively), but its cross-machine direction dry tensile strength (3039 g/3") is considerably higher than that of the machine direction hexagonal-embossed web (1688 g/3"). In addition, compared to the tensile ratio of the base sheet (1.32), the cross-machine direction perforate embossed web has a lower ratio (1.16), while the machine direction perforate embossed web has a higher ratio (2.58). Thus the method of the present invention provides a convenient, low cost way of "squaring" the sheet—that is, bringing the tensile ratio closer to 1.0.

Higher caliper at equivalent finished product cross-machine direction tensile strength is illustrated by three examples presented in Table 3. For each example a common base sheet (identified above each data set) was perforate embossed with a cross-machine direction and a machine direction oriented pattern (Hollow Diamond is a machine direction oriented perforate emboss).

TABLE 3

| Increased Caliper at Equivalent CD Tensil Strength | | | | | |
|---|---|---|---|---|---|
| Emboss (perforate) | Basis Wt. (lbs/R) | Caliper (mils) | MD Dry Tensil (g/3") | CD Dry Tensil (g/3") | Dry Tensil Ratio (MD/CD) |
| Base Sheet--undulatory blade-creped, CWP base sheet with tensile ratio = 1.32 | | | | | |
| CD Quilt | 28.8 | 108 | 4773 | 4068 | 1.17 |
| MD Quilt | 28.8 | 78 | 6448 | 3880 | 1.66 |
| Base Sheet--undulatory blade-creped, CWP base sheet with tensile ratio = 1.32 | | | | | |
| CD Quilt | 29.5 | 154 | 2902 | 2363 | 1.23 |
| MD Quilt | 29.5 | 120 | 5361 | 2410 | 2.22 |
| Base Sheet--undulatory blade-creped, CWP base sheet with tensile ratio = 1.94 | | | | | |
| CD Oval | 24.6 | 75 | 4805 | 2551 | 1.88 |
| Hollow Diamond | 24.1 | 56 | 5365 | 2364 | 2.27 |

In each case, the cross-machine direction perforate embossed product displays enhanced caliper at equivalent cross-machine direction dry tensile strength relative to its machine direction perforate embossed counterpart. Also, the cross-machine direction perforate embossed product has a lower tensile ratio, while the machine direction perforate embossed product a higher tensile ratio, when compared to the corresponding base sheet.

While the above results are specifically directed to perforate embossed webs, we would expect similar results when non-perforate embossing.

The current invention further allows for a substantial reduction in base paper weight while maintaining the end product performance of a higher basis weight product. As shown below in Table 4, wherein the web is formed of recycled fibers, the lower basis weight cross-machine direction perforate embossed towels achieved similar results to machine direction perforate embossed toweling made with higher basis weights.

TABLE 4

| Performance Comparisons. | | | | |
|---|---|---|---|---|
| EMBOSS | Hollow Diamond (MD Perforate) | CD Oval (CD Perforate) | Hollow Diamond (MD Perforate) | CD Oval (CD Perforate) |
| BASIS WT (LBS/REAM) | 24.1 | 22.2 | 31.3 | 28.9 |
| CALIPER | 56 | 62 | 76 | 81 |
| DRY MD TENSILE (g/3") | 5365 | 5057 | 5751 | 4144 |
| DRY CD TENSILE (g/3") | 2364 | 2391 | 3664 | 3254 |
| MD STRETCH (%) | 7.6 | 8.1 | 8.8 | 10.1 |
| CD STRETCH (%) | 6.3 | 6.1 | 5.5 | 5.3 |
| WET MD CURED TENSILE (g/3") | 1236 | 1418 | 1409 | 922 |
| WET CD CURED TENSILE (g/3") | 519 | 597 | 776 | 641 |
| MacBeth 3100 BRIGHTNESS (%) | 72.3 | 72.6 | 73.3 | 73.4 |
| SAT CAPACITY (g/m$^2$) | 98 | 102 | 104 | 119 |
| SINTECH MODULUS | 215 | 163 | 232 | 162 |
| BULK DENSITY | 367 | 405 | 340 | 385 |
| WET RESILIENCY (RATIO) | 0.735 | 0.725 | 0.714 | 0.674 |

In Table 4, two comparisons are shown. In the first comparison, a 24.1 lbs/ream machine direction perforated web is compared with a 22.2 lbs/ream cross-machine direction perforated web. Despite the basis weight difference of 1.9 lbs/ream, most of the web characteristics of the lower basis weight web are comparable to, if not better than, those of the higher basis weight web. For example, the caliper and the bulk density of the cross-machine direction perforated web are each about 10% higher than those of the machine direction perforated web. The wet and dry tensile strengths of the webs are comparable, while the Sintech modulus of the cross-machine direction perforated web (i.e., the tensile stiffness of the web, where a lower number is preferred) is considerably less than that of the machine direction perforated web. In the second comparison, similar results are achieved in the sense that comparable tensile ratios and physicals can be obtained with a lower basis weight web. Paradoxically, consumer data indicates that the 28#29C8 product was rated equivalent to the 30.5#HD product while the 22#30C6 product was at statistical parity with the 20204 product, but was possibly slightly less preferred than the 20204 product.

Figure 23:
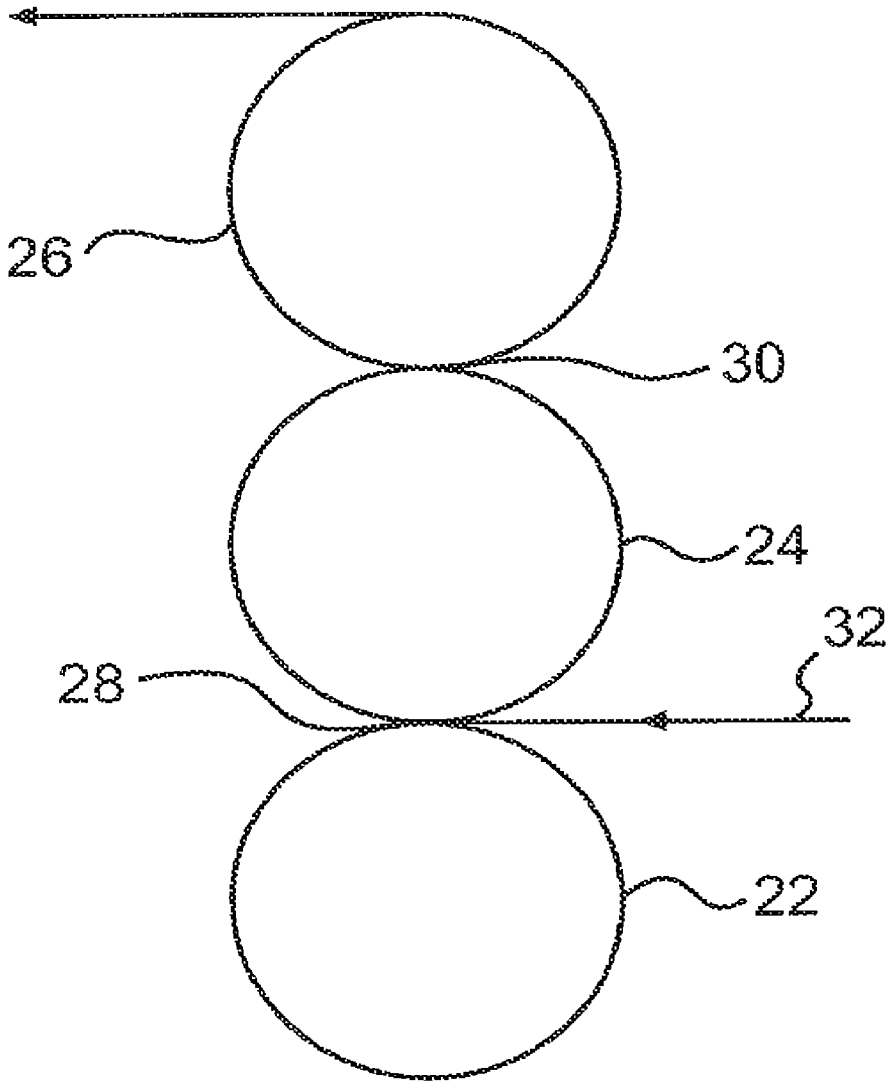
FIG. 23 illustrates a three-roll embossing unit according to a second embodiment of the present invention.
Figure 24:
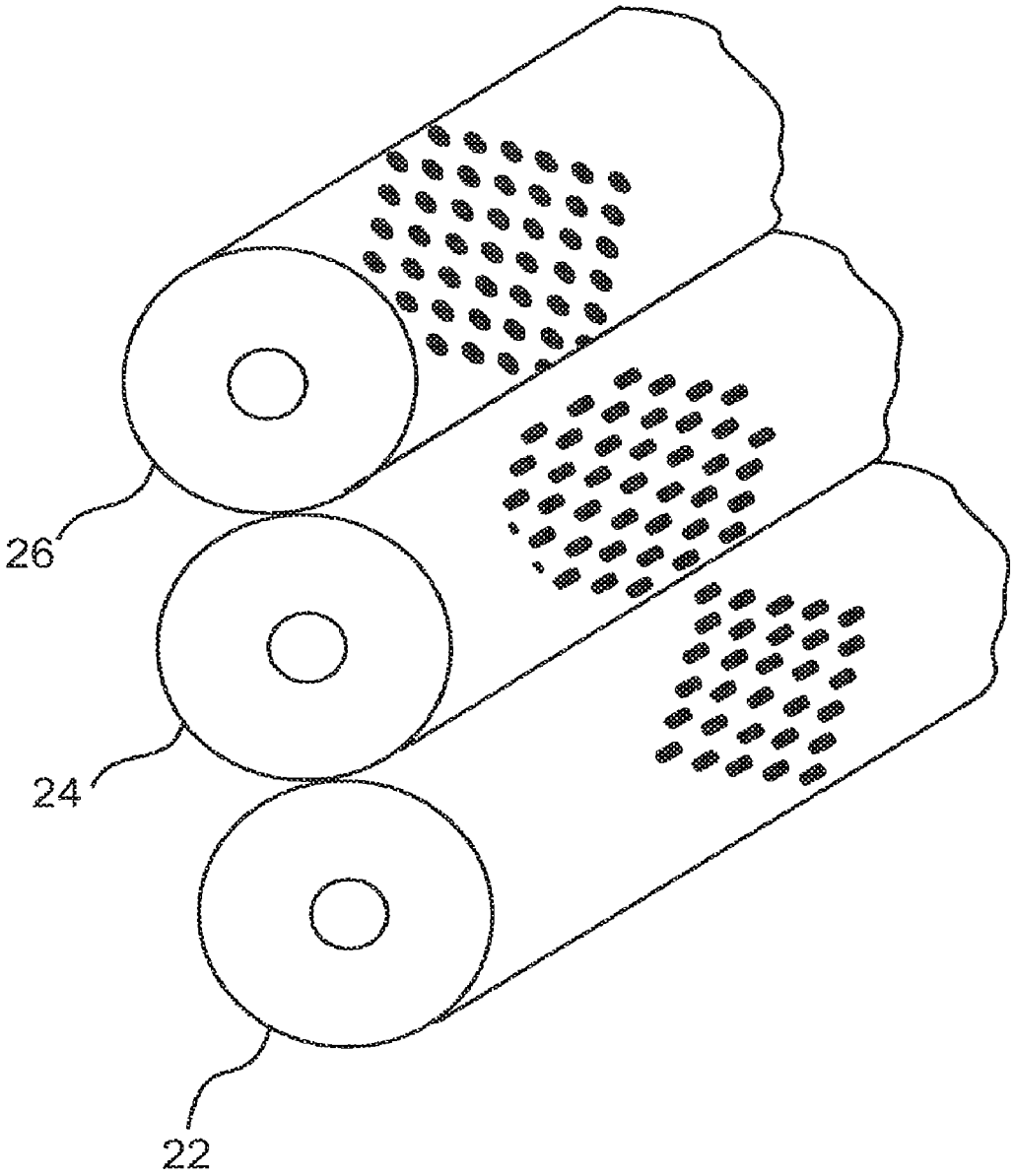
FIG. 24 is a perspective of a three-roll embossing unit, each of the embossing rolls having male embossing elements, according to a second embodiment of the present invention.
Figure 25:
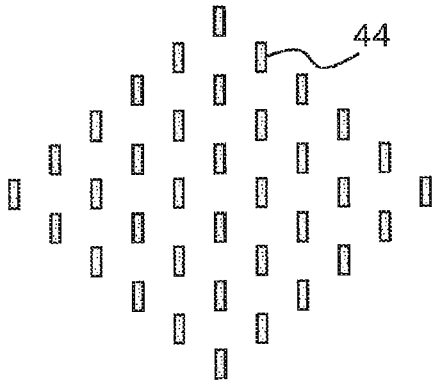
FIG. 25 illustrates an oval-shaped machine direction embossing pattern according to a second embodiment of the present invention.

In another embodiment, as shown in FIGS. 23 and 24, the converting process may include an embossing unit 20 of three embossing rolls 22, 24, 26 defining two nips 28, 30 through which the web 32 to be embossed is passed. The first and second rolls 22, 24 may be as described above. The third roll 26 may have a substantial portion of the embossing elements 44 oriented such that the long direction axis of the substantial portion of the embossing elements 44 is in the machine direction, as shown in FIG. 25. The third roll 26 may have a substantial portion of the embossing elements 44 oriented in the cross-machine direction. The two nips 28, 30 may be perforate or non-perforate. In one embodiment, one nip is perforate and the other nip is non-perforate.

Figure 4:
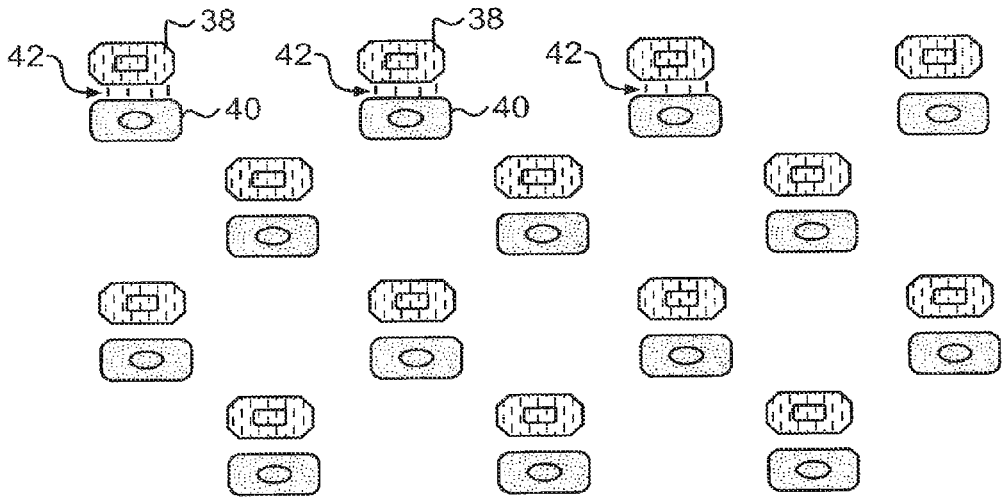
FIG. 4 illustrates a cross-machine direction embossing pattern imparted to a web according to an embodiment of the present invention.
Figure 26:
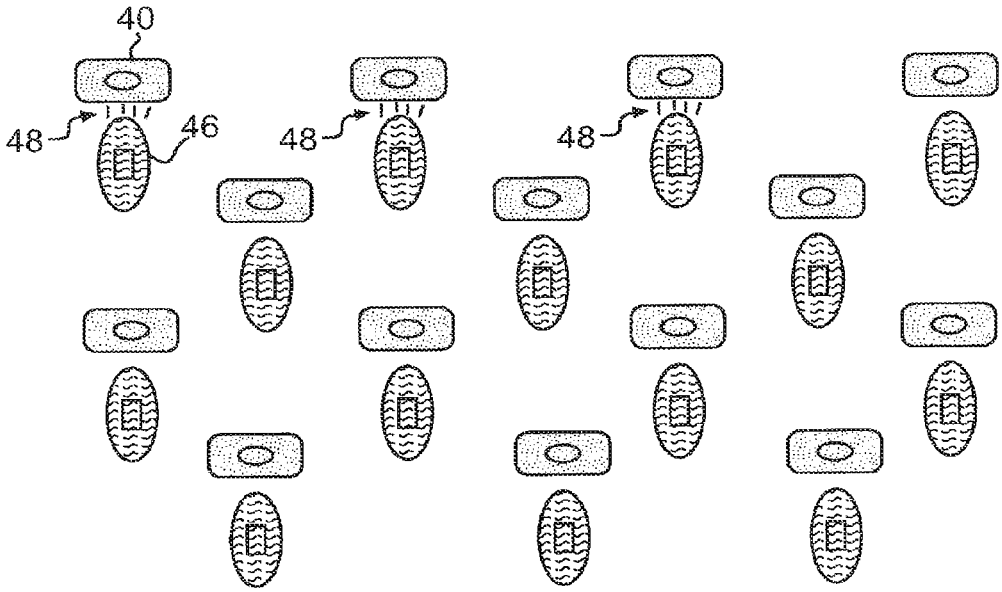
FIG. 26 illustrates a cross-machine/machine direction embossing pattern imparted to a web according to a second embodiment of the present invention.
Figure 27:
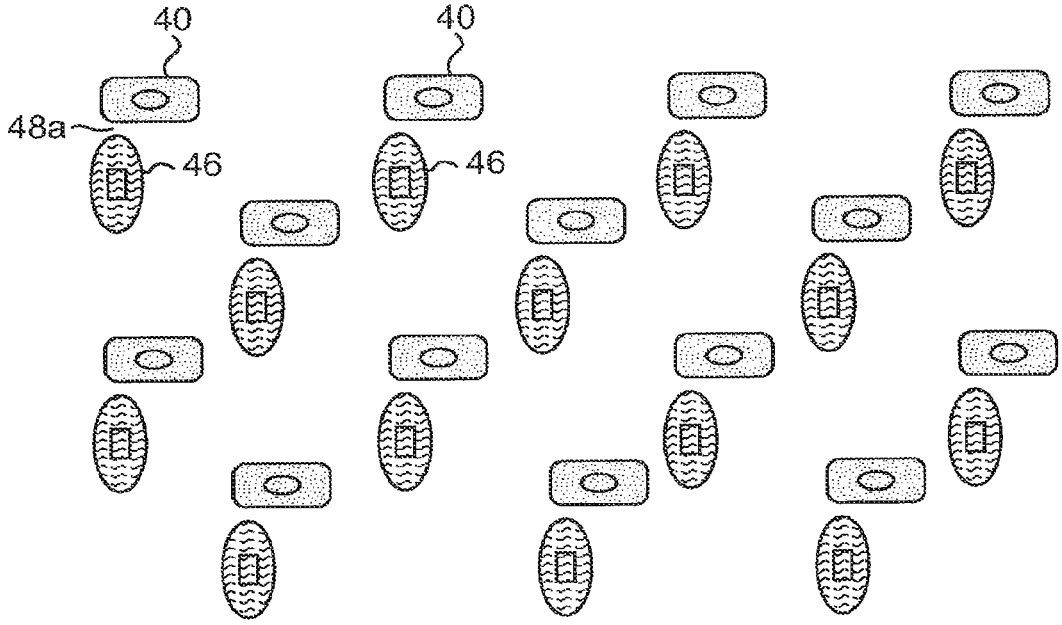
FIG. 27 illustrates a variation of a cross-machine/machine direction embossing pattern imparted to a web according to a second embodiment of the present invention.
Figure 28:
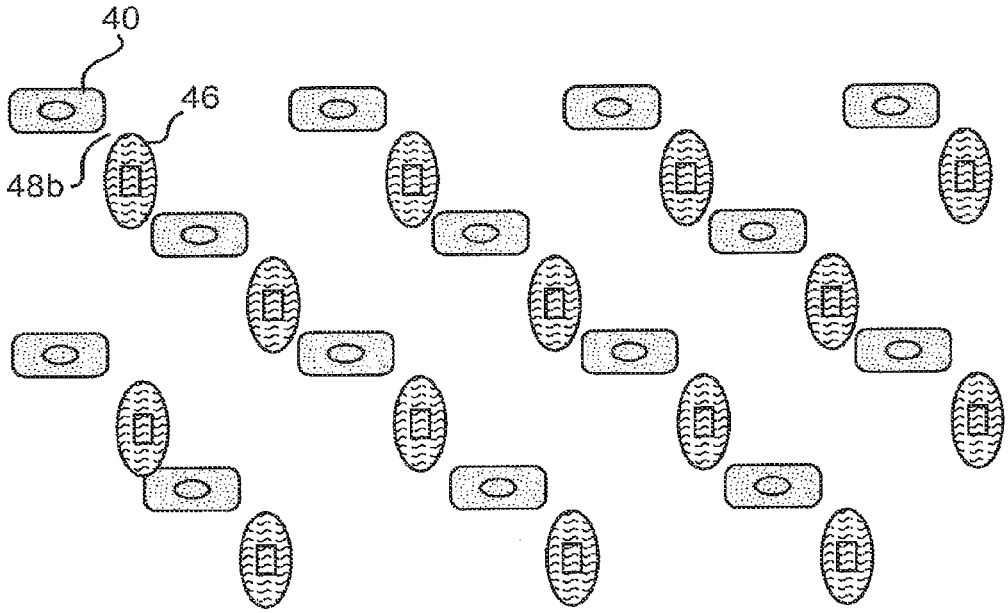
FIG. 28 illustrates another variation of a cross-machine/machine direction embossing pattern imparted to a web according to a second embodiment of the present invention.
Figure 29:
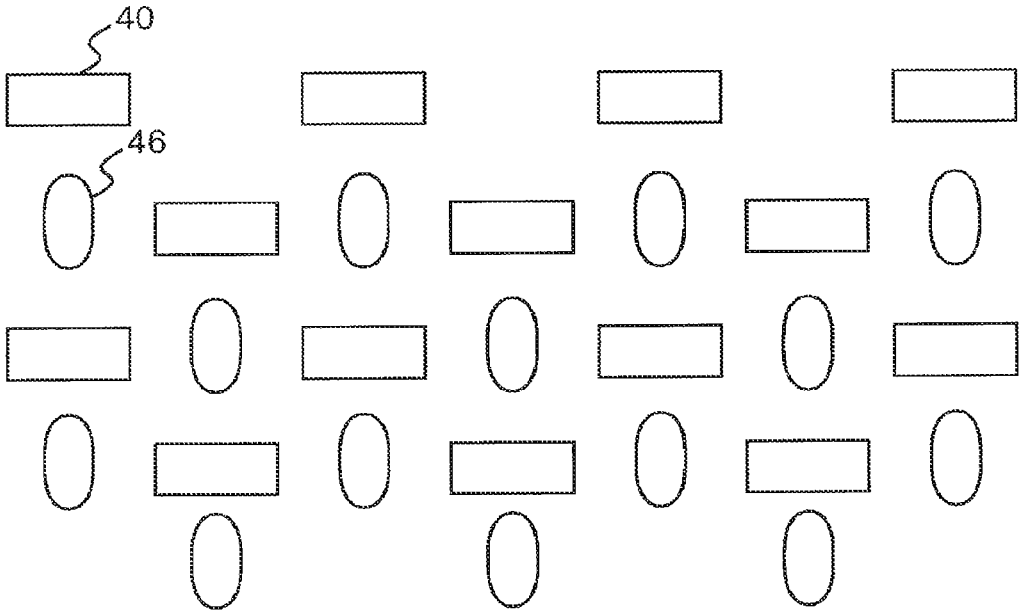
FIG. 29 illustrates yet another variation of a cross-machine/machine direction embossing pattern imparted to a web according to a second embodiment of the present invention.

As described above, the web 32 is first passed through the first nip 28 and engaged between the interpenetrating male elements 34, 36 of first and second rolls 22, 24 to produce an embossed pattern on the web 32 similar to that shown in FIG. 4. In this embodiment, however, as the web 32 passes around the second roll 24, it enters the second nip 30 formed by the second and third rolls 24, 26, wherein the sheet is further worked by the interpenetrating male embossing elements 44. As shown in FIG. 25, the long direction axis of the elongated male embossing elements 44 of the third roll 26 may be aligned with the machine direction of the web 32. One pattern that may be imposed on the web 32 by the second nip 30 is shown in FIG. 26, where the debosses 40 and the bosses 46 are aligned in roughly a "T" orientation, with the region 48 between the debosses 40 and the bosses 46 being heavily worked. As with the first nip embossing pattern, it is possible to vary the degree to which the regions 48 are worked by adjusting the degree of interpenetration of the elements on rolls 24, 26. Further, it is also possible to vary the location and extent of regions 48*a* by shifting the roll 26 along its axis of rotation relative to roll 24 to produce alternate patterns such as are shown in FIGS. 27 and 28. Or, as shown in FIG. 29, the length in the machine direction of the worked regions 48*b* can be varied by adjusting the phase of the rolls with respect to one another. Those of ordinary skill in the art will understand that a variety of patterns can be affected by adjusting the axial location and phase of one or more of the rolls.

Figure 30:
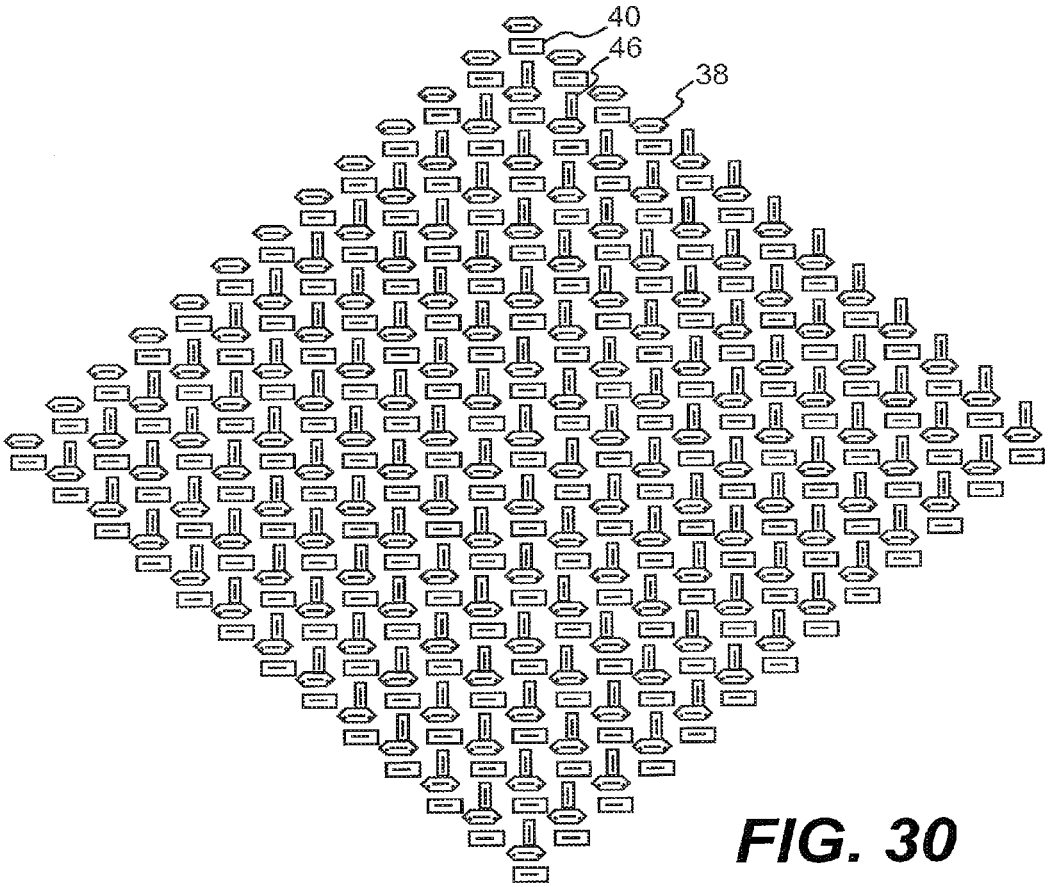
FIG. 30 illustrates a final cross-machine/machine direction embossing pattern imparted to a web according to a second embodiment of the present invention.
Figure 31:
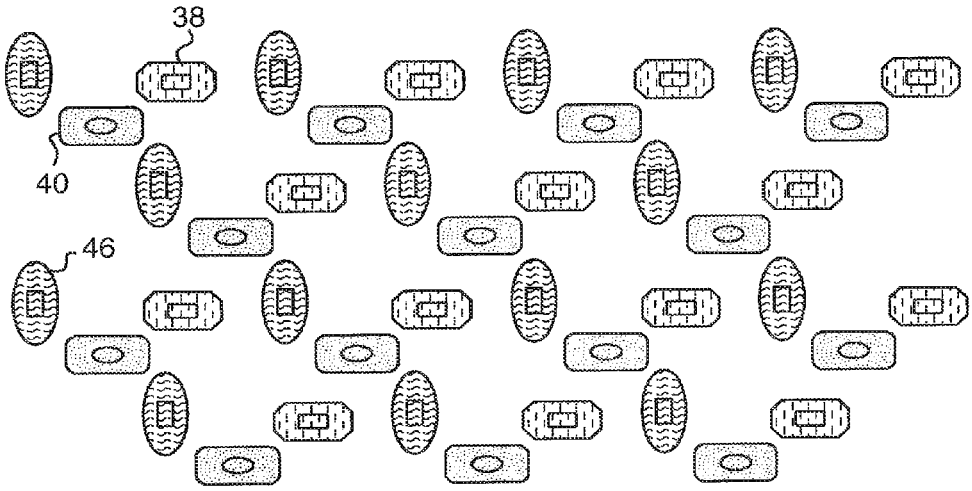
FIG. 31 illustrates a variation of a final cross-machine/machine direction embossing pattern imparted to a web according to a second embodiment of the present invention.
Figure 32:
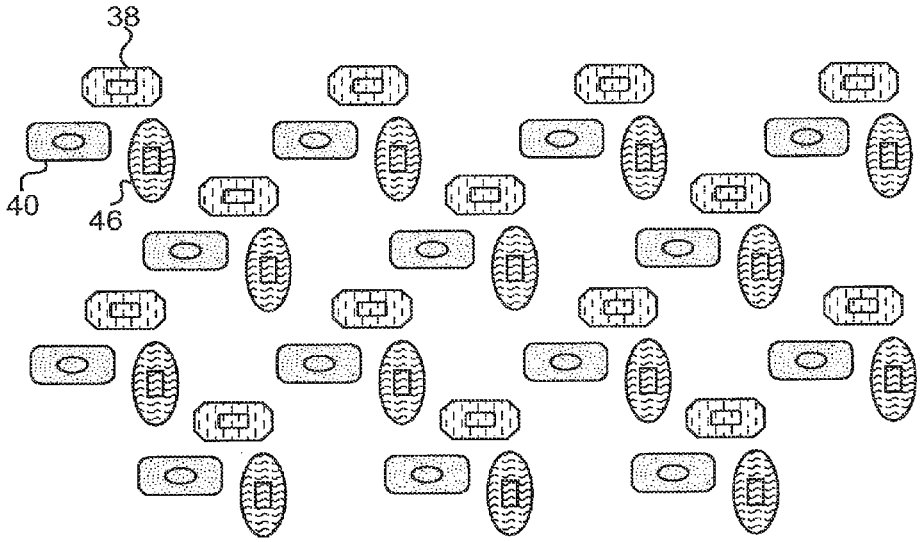
FIG. 32 illustrates another variation of a final cross-machine/machine direction embossing pattern imparted to a web according to a second embodiment of the present invention.
Figure 33:
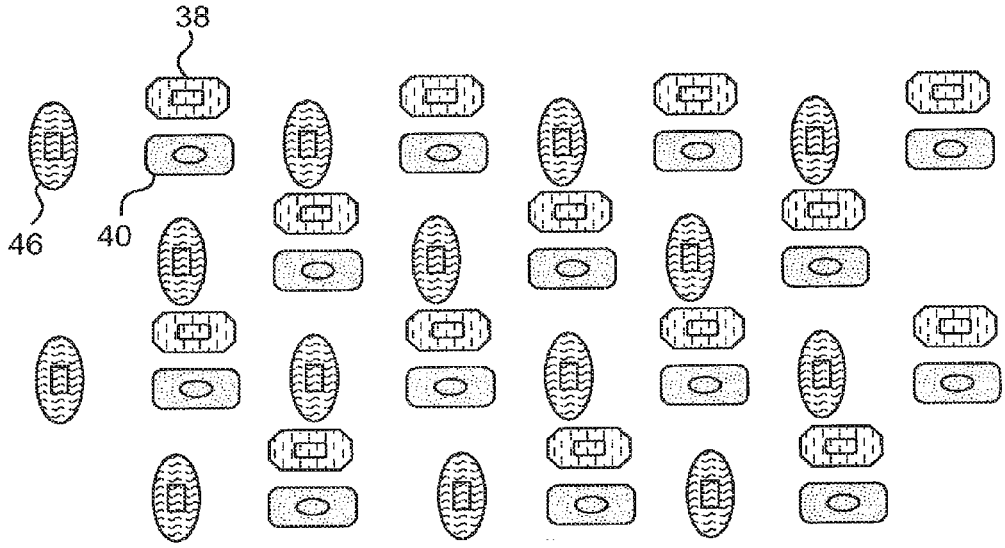
FIG. 33 illustrates yet another variation of a final cross-machine/machine direction embossing pattern imparted to a web according to a second embodiment of the present invention.
Figure 34:
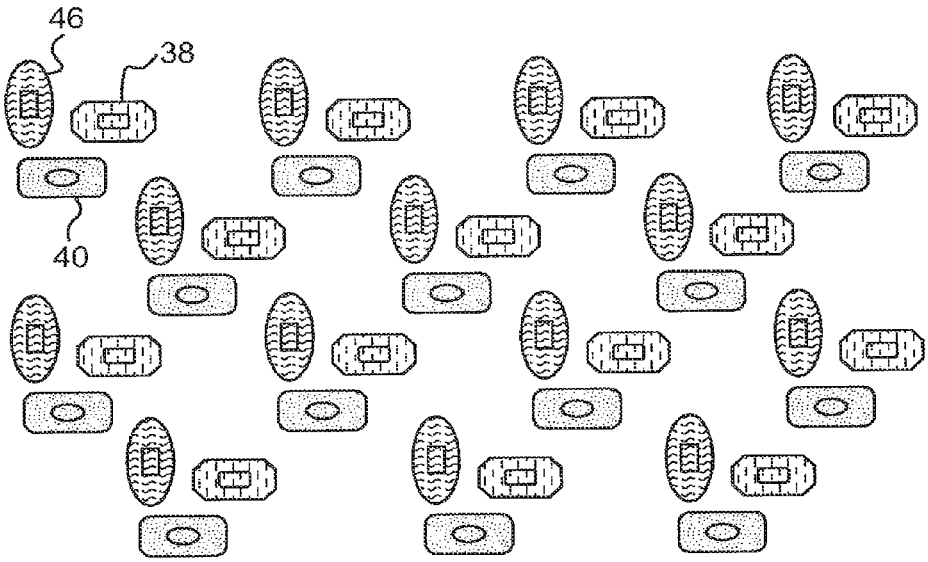
FIG. 34 illustrates still another variation of a final cross-machine/machine direction embossing pattern imparted to a web according to a second embodiment of the present invention.

FIG. 30 illustrates not only an embossed pattern that may be imparted on the web 32 as it passes through the second nip 30, but also the vestigial pattern that may remain in the web 32 as a consequence of the passage through the first nip 28. It can be appreciated that the degree to which the regions 42, 48 are worked can be varied simply by adjusting the degree of interpenetration of the respective rolls 22, 24, 26. Moreover, the location and extent of these regions can be modified by adjusting the phase and axial displacement of the rolls 22, 24, 26 relative to each other to produce patterns such as those shown in FIGS. 31-34.

Figure 35:
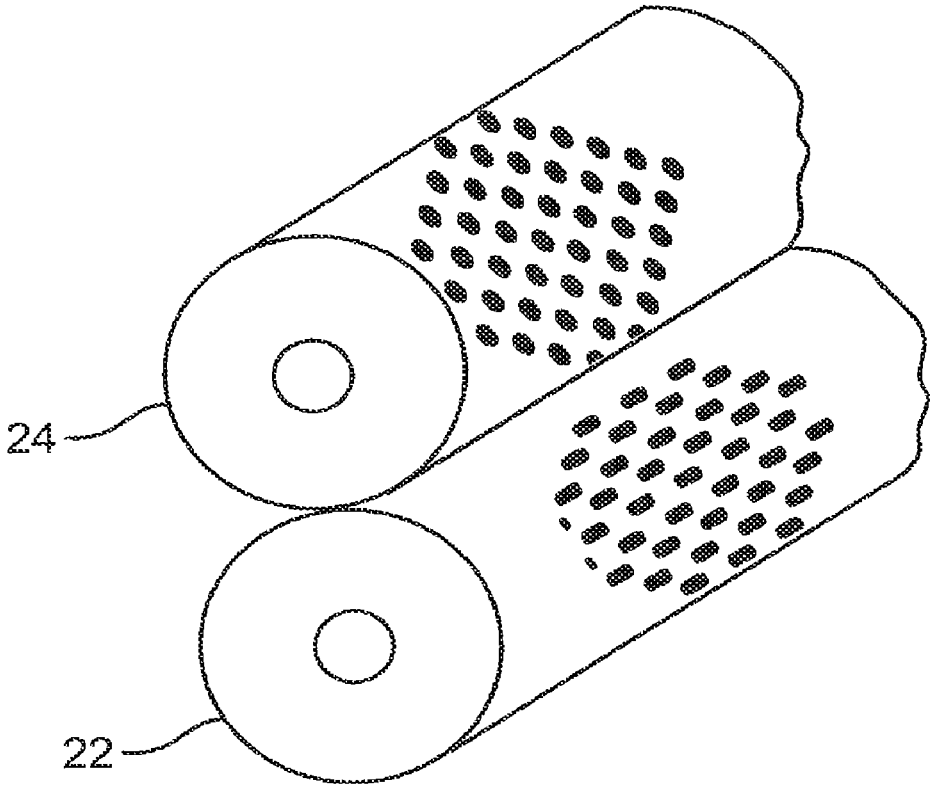
FIG. 35 illustrates a two-roll embossing unit according to a third embodiment of the present invention.

In yet another embodiment, the converting process may include an embossing unit 20 of two embossing rolls 22, 24 defining a nip 28 through which the web 32 to be embossed is passed, similar to as described above in FIG. 1. In this embodiment, however, the embossing elements of the two rolls are oriented in different directions, as shown in FIG. 35. That is, the long direction axis of the embossing elements of one of the embossing rolls is substantially oriented in the cross-machine direction, while the long direction axis of the embossing elements of the second roll is oriented in the machine direction. For example, the first roll 22 may include a pattern of rectangular-shaped male elements 36 aligned in a staggered array as shown in FIG. 3, with the long direction axis of the rectangular-shaped male elements 36 oriented in the cross-machine direction of the web 32 to be embossed. The second roll 24 may include a plurality of interpenetrating oval-shaped male elements 44 where the long direction axis of the elements 44 is oriented in the machine direction, as shown in FIG. 25. The oval-shaped male elements 44 may be aligned perpendicular the rectangular-shaped male elements 36 on the first roll 22 so that upon passing through the first nip 28, the web 32 is engaged between the interpenetrating male elements 36, 44 of the first and second rolls 22, 24, respectively. Such an arrangement may produce an embossed pattern on the web 32 similar to that previously described in FIG. 26 in which the bosses 40 formed by the rectangular-shaped male elements 36 on first roll 22 are perpendicular to the debosses 46 formed by interpenetrating oval-shaped male elements 44 on the second roll 24. This alignment allows degradation of the web 32 in both directions while using only two rolls having a single nip.

Moreover, this embodiment maintains the flexibility found in the other embodiments. In particular, by adjusting the degree of interpenetration of the rectangular-shaped male elements 36 on the first roll 22 and the elongated oval-shaped male elements 44 on the second roll 24, the degree to which the region 48 between the bosses 40 and the debosses 46 are worked may be varied. Similarly, as previously described in FIG. 27, by shifting roll 24 along its axis of rotation with respect to roll 22, it is possible to adjust the location and extent of heavily worked regions 48*a*. Or, as previously described in FIG. 28, the length in the machine direction of the worked regions 48*b* may be varied by adjusting the phase of the rolls with respect to one another.

Those of ordinary skill in the art will understand that with each of the above-described embodiments a variety of embossing element shapes can be employed, both in the cross-machine and machine directions. Moreover, those of ordinary skill in the art will understand that a variety of patterns can be affected from the selected embossing element shapes by shifting the phase and/or axial location of the rolls with respect to each other.

In one embodiment of the present invention, precision gearing and precision hubs are used to significantly reduce or eliminate circumferential alignment drift of the embossing rolls. In particular, in an embossing operation, either perforate or non-perforate, the opposing embossing elements on the embossing rolls are in close proximity to one another. As the embossing rolls rotate during the embossing process, the embossing rolls may have a tendency to drift circumferentially relative to one another. If the embossing rolls drift circumferentially, it is possible that the cross-machine direction elements will interfere with each other, potentially leading to unwanted degradation of the paper web and, ultimately, to damage or destruction of the elements themselves.

Precision gearing and precision hubs can be used to significantly reduce or eliminate circumferential alignment drift of the embossing rolls. In one embodiment, a precision gear used in the present invention is formed of pre-heat treated material. In another embodiment, a precision gear used in the present invention is formed by precision grinding the stock material, i.e., a ground gear. In yet another embodiment, shaved gears are used.

Figure 36:
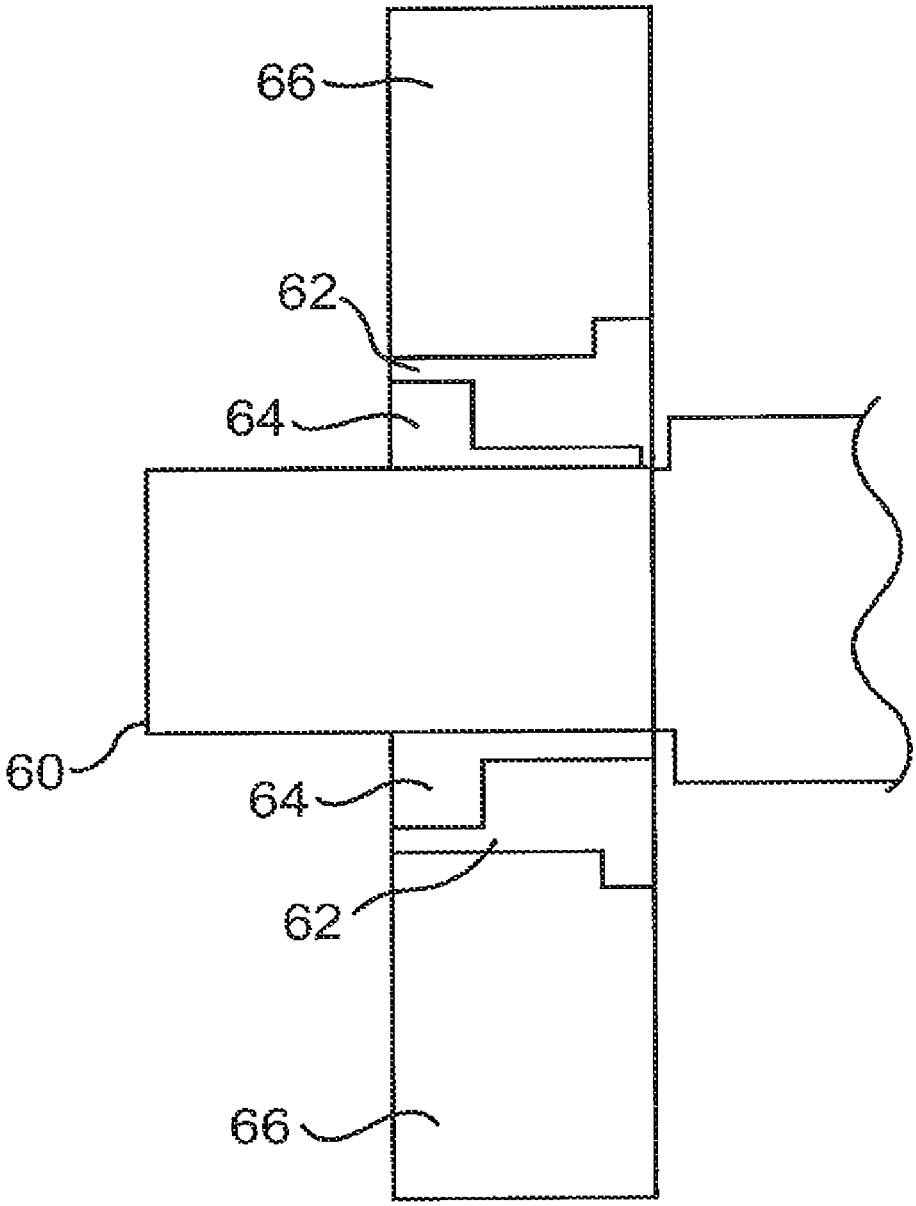
FIG. 36 depicts a sectional view of a gear and hub assembly of an embossing roll system usable in an embodiment of the present invention.

FIG. 36 depicts the end of an embossing roll 22, including a journal 60. The journal 60 is in communication with the embossing roll 22 and transmits rotational movement from the gearing system to the embossing roll 22. Also shown in FIG. 36 is the gear assembly. The gear assembly includes a gear 66, a bushing 64, and a hub 62. The hub 62 and bushing 64 are in direct communication. In particular, the bushing 64 is press-fit into the inner diameter of the hub 62. In addition, the gear 66 and hub 62 are also in direct communication. In operation, the gear 66 transmits rotational movement to the hub 62 and bushing 64, which in turn transmit rotational movement to the journal 60 and embossing roll 22. In the embodiment depicted in FIG. 36 the gear is external to the roll. Those of ordinary skill in the art will understand, however, that the gear 66 may be integral with the embossing roll 22.

The precision gearing for the present invention may have at least two elements. First, the gear may be formed with high machine tolerances. Second, the hub and bushing, in which the journal rests, may be formed with high tolerances in order to maintain the concentricity of the embossing roll.

As noted above, in standard gearing mechanisms the gears are constructed by first forming the gears out of metal block. To achieve the hardness levels required for operating conditions, conventional gears are heat treated after the gear teeth are formed. The heat treating process typically causes deformation in the gears and, therefore, the gears lack the necessary precision for certain applications. There are three major techniques for improving the accuracy of gearing which can be used singly or in combination to achieve the requires degree of precision: use of pre-heat treated steel, shaving, and precision grinding. In one embodiment of the present invention, the gear is formed of a base material that has been heat treated, i.e., a pre-heat treated base material, thus obviating potential deformations created by heat-treating after the teeth are formed. The base material can be carbon steel, iron, or other materials or alloys known to those of ordinary skill in the art, or later discovered, to have sufficient hardness for the present application. One steel that has been used is 4150 HR STL RND, which has been pre-heat treated to 28-32 Rockwell C. The base material is then hobbed to form the gear structure. The hobbing process includes machining away the base material and then, if even higher precision is required, shaving or precision grinding of the remaining material can be used to form the precision gear. Precision grinding can also be used to improve precision in gears that have been heat-treated after hobbing. The pitch line TIR (total indicated runout, as measured according to ANSI Y14.5M) on the gear should not exceed 0.001". Because heat treating is not required after the gear is formed by the hobbing process when pre-heat treated steel is used, the gear is not distorted after the gear has been formed.

In another embodiment of the present invention, the gears are shaved gears. Shaved gears may be formed using the following process. First, the non-pre-heat treated material is hobbed. While the process is similar to the hobbing process described above, the gear is hobbed to be larger than the desired final dimensions. Next the gear is heat treated. After the heat treatment, the gear is then re-hobbed according to the desired final dimensions.

In yet another embodiment of the present invention, the gears are precision ground. Precision in gearing is identified by a grading scale. In particular, the AGMA (American Gear Manufacturers Association) rates the precision, or quality, of a gear on a "Q" scale. (See "Gear Classification and Inspection Handbook," ANSI/AGMA 2000-A88 (March 1988).) For example, the highest precision can generally be found in a ground gear. Ground gears generally have a precision grading of Q-10. Hobbed gears, formed from pre-heat treated material as described above, generally have a precision grading of Q-8: Heat treated gears, on the other hand, generally have a grading of Q-6 or less. The precision gears of the present invention should have a precision rating of greater than Q-6. In one embodiment the precision gears have a precision rating of at least about Q-8. In another embodiment of the present invention, the gears have a precision rating of at least about Q-10. Those of ordinary skill in the art will be able to select the appropriate precision gear based on a variety of factors, including precision desired and cost of gearing.

Figure 37:
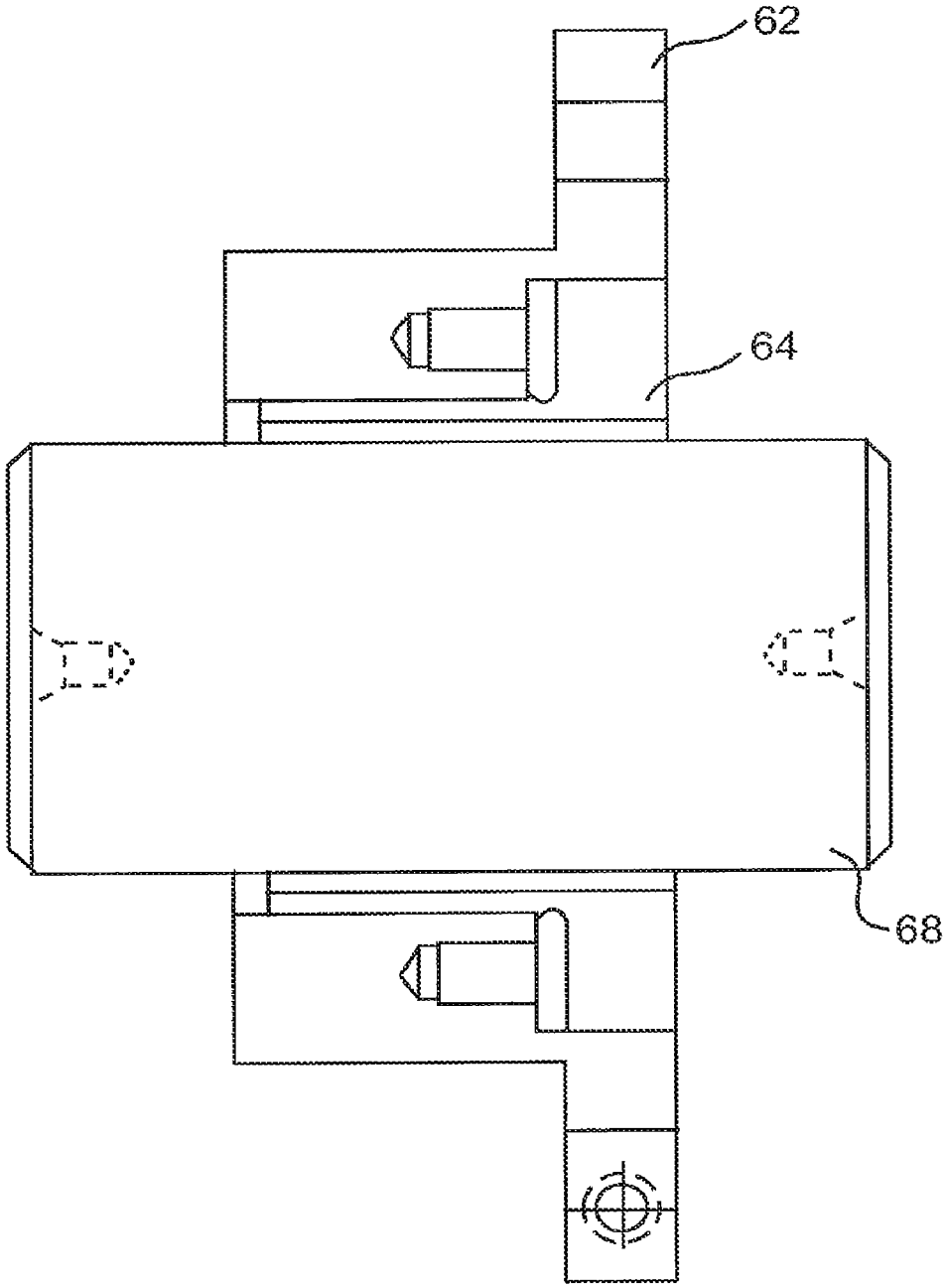
FIG. 37 depicts a sectional view of a hub assembly usable in an embodiment of the present invention.

When using a precision gear, a precision hub assembly may also be used. The hub assembly is depicted in FIG. 37. The hub assembly includes the hub 62 and the bushing 64. According to one embodiment, the hub 62 is in press-fit communication with the bushing 64. The hub assembly is capable of receiving the embossing roll journal. Moreover, the hub assembly is capable of transmitting rotational movement to the journal. In one embodiment, the hub assembly is precision formed. Referring to FIG. 37, the precision hub assembly of the present invention is formed by machining the hub 62 and the bushing 64 together. In particular, the hub 62 is placed on an arbor 68 and the bushing 64 is then press-fit between the hub 62 and the arbor 68. The hub 62 and bushing 64 are then machined to the appropriate dimensions for the application. In particular, the outer diameter of the hub 62 and bushing 64, and the face of the hub 62 and bushing 64 are machined as an assembly. After machining, the hub assembly is removed from the arbor and placed in communication with the embossing roll journal. The precision formed hub assembly is capable of providing concentricity for the embossing roll when it is rotating. A hub may be considered a precision hub when the tolerances are such that the effect is a reduction or elimination in the circumferential alignment drift of the embossing rolls. In particular, tolerance should be between approximately 0.00-and 0.0003" TIR on the hub assembly outer diameter. In many cases, it will be advantageous to mount the gears to the roll using a bolt pattern which allows the hub to be only mounted when the hub is at a fixed angular position on the roll. Often this is achieved by using uneven angular spacing of the bolt holes.

The resulting improvement from using precision gearing as compared to standard gearing is evidenced by a reduction in the circumferential alignment drift of the embossing rolls when using precision gearing. Circumferential alignment drift in the embossing rolls is evidenced by non-uniformity of the clearance between adjacent engaged embossing elements. Clearance, according to the present invention, is the distance between adjacent engaging embossing elements. Accordingly, when the ranges of clearance differences between the elements is significant, embossing roll circumferential alignment drift may be present.

Figure 39:
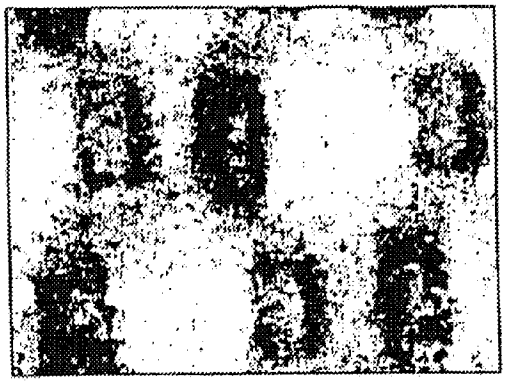
FIGS. 38-41 are photomicrographs illustrating the effect of element drift according to an embodiment of the present invention.
Figure 38:
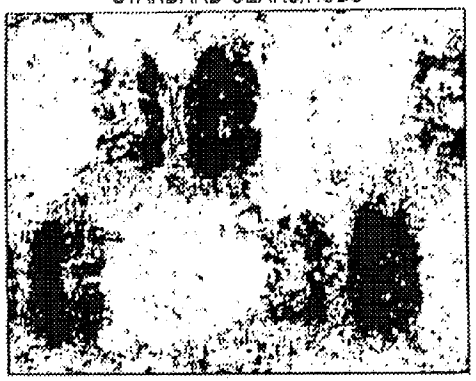

FIGS. 38-41 are photomicrographs showing the clearances between adjacent engaging embossing elements for two different embossing roll sets. In particular, FIGS. 38 and 39 are photomicrographs of a web that has been cross-machine direction perforate embossed by embossing rolls having standard gearing. FIGS. 38 and 39 show the amount of drift between adjacent elements for one revolution of the embossing roll set. FIG. 38 depicts the closest clearance between the elements while FIG. 39 depicts the furthest clearance between the elements. Comparing FIGS. 38 and 39, the difference between the closest and furthest clearance is significant, thereby reflecting a significant circumferential drift in alignment between the embossing rolls.

Figure 41:
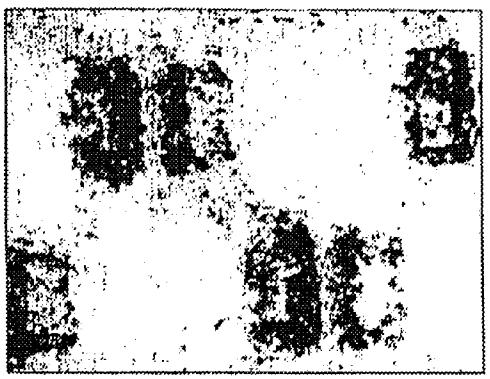
Figure 40:
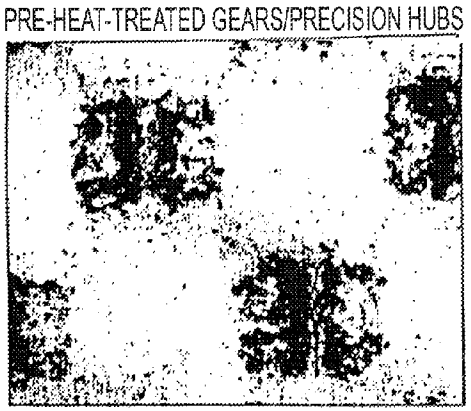

FIGS. 40 and 41, on the other hand, are photomicrographs of a web that has been cross-machine direction perforate embossed by embossing rolls using pre-heat treated gears. FIGS. 40 and 41 show the amount of drift between adjacent elements for one revolution of the embossing roll set. FIG. 40 depicts the closest clearance between the elements while FIG. 41 depicts the furthest clearance between the elements. Comparing FIGS. 40 and 41, the difference between the closest and furthest clearances between the elements is minor, thereby reflecting a minor circumferential drift in alignment between the embossing rolls. Accordingly, it is evident that precision gearing reduces the circumferential alignment drift between the embossing rolls.

Those of ordinary skill in the art will be able to determine the acceptable amount of embossing roll circumferential alignment drift. In particular, embossing roll circumferential alignment drift should be minimized to avoid interference between the adjacent engaging elements and to minimize non-uniformity of the perforate embossed web. In addition, those of ordinary skill in the art will understand that the current invention is applicable to other applications, such as perforate embossing operations having elements in both the machine and cross-machine directions.

In another embodiment of the present invention, at least one of the embossing rolls is crowned. A caliper profile may exist when perforating a web in the cross-machine direction. In particular, when perforating a web in the cross-machine direction at operating speeds, in some instances the caliper of the perforated web near the ends of the embossing rolls may be greater than that at the middle of the roll. This caliper profile indicates that a higher degree of perforation was accomplished near the ends of the embossing rolls. In theory, it is believed that this profile is a function of the speed of the web as it is perforated.

To test this theory, an experiment was conducted. In the experiment, caliper profiles for a cross-machine direction perforated product were collected. In particular, a web was embossed at both a low running speed and a high, operating speed. The embossing elements were in half-step alignment. Seven caliper readings, data points 1-7, were taken across the width of each perforated web. Data points 1 and 7 were located at the opposite ends of the cross-machine direction width of the web, while points 2-6 were located therebetween. To determine the magnitude of a caliper profile, the following formula was used: $Delta_c$=avg. caliper (1 & 7)−avg. caliper (2-6). The following data was collected.

TABLE 5

| TRIAL | RUN SPEED (FPM) | $DELTA_C$ (MILS) |
|---|---|---|
| 1 | 454 | 2.7 |
| 1 | 103 | 0.7 |
| 2 | 436 | 8.7 |
| 2 | 98 | 1.5 |
| 3 | 516 | 7.6 |
| 3 | 100 | 4.3 |
| 4 | 480 | 6.2 |
| 4 | 100 | −2.0 |

As indicated above, for each of the trials the caliper profile, i.e., the difference in caliper between the end portions of the web versus the middle of the web, was more pronounced when the web was perforated at high, operational, speeds. In particular, when operating at higher, operational speeds the average $Delta_c$ was 6.3. When operating at lower speeds, on the other hand, the average $Delta_c$ was 1.1. In theory, it is believed that the caliper profile exists because the embossing rolls flex when the web is embossed at operational speeds. It is further believed that the profile exists because, while the ends of the rolls are fixed at the bearings, the middle of the roll is free to flex, thus resulting in a caliper profile. That is, the middle of the roll is allowed to flex away from the web and, thus, does not emboss the middle portion of the web at the same level as the ends of the roll.

When it is desired to reduce the caliper profile, a crowned embossing roll may be used. In one embodiment, only one embossing roll of the embossing roll set is crowned. In another embodiment, both embossing rolls of an embossing roll set are crowned. An embossing roll for use according to the present invention may be from about 6 inches to about 150 inches in width. The average diameter of the embossing roll for use with this invention may be from about 2.5 inches to at least about 20 inches. Selection of the appropriate diameter and width of the embossing roll would be apparent to the skilled artisan based upon a variety of factors, including the width of the web to be embossed and the specifics of the converting machine being used.

In one embodiment, an embossing roll is provided wherein the diameter of the center portion is greater than that of the ends. That is, the roll is crowned by reducing the diameter of a portion of the embossing roll. In particular, the diameter of the embossing roll is gradually reduced when moving from the center portion of the embossing roll towards the ends of the embossing roll. In one embodiment the reduction towards the ends of the roll being greater such that the shape of the crown is generally parabolic. The diameter of the embossing roll may be decreased at the ends from about 1-8 mils. In one embodiment, using an embossing roll having a 10 inch diameter and a 69 inch width, the diametrical crown at the end of the roll is about −2 mils, i.e., the diameter of the ends of the roll is 2 mils less than that at the greatest diameter of the roll. In one embodiment, the diametrical crown at the ends of the roll is approximately −2.4. Those of ordinary skill in the art will be able to determine the appropriate diameters of the reduced diameter portions based on a variety of factors, including the desired physical properties of the finished product, the projected speed of the web, the properties of the base sheet being perforate embossed, and the width and diameter and construction of the emboss rolls. In addition, those of ordinary skill in the art will understand that when only one embossing roll is crowned, instead of both embossing rolls, it may be necessary that the crown of the crowned roll be greater.

In one example of the above embodiment, the two opposing embossing rolls were crowned. The first embossing roll was crowned at a maximum of 4.1 mils and the second embossing roll crowned at a maximum of 3.8 mils. That is, the maximum diameter reductions in the first and second rolls were 4.1 mils and 3.8 mils, respectively. Tables 6 and 7, below, show the crown dimensions of each of the rolls. The rolls had an embossed face length of 69". The reference points were measured in approximately 5" intervals. The reference point distance is the distance from the reference point to the journal end of the roll. At the center point of the roll, approximately 35" from the journal end, the crown is "0" as that is the largest diameter. The crown, or difference in diameter between the center point and the reference point, is shown in negative numbers to indicate that the diameter at that point is less than the center point diameter. As indicated, the diameter of the roll decreases gradually as the distance from the center point increases.

TABLE 6

| Roll 1 | | |
|---|---|---|
| Reference Point (inches) | Diameter of Embossing Roll (inches) | Crown (mils) |
| 1 | 10.0251 | −4.1 |
| 5 | 10.0262 | −3.0 |
| 10 | 10.0273 | −1.9 |
| 15 | 10.0276 | −1.6 |
| 20 | 10.0281 | −1.1 |
| 25 | 10.0284 | −0.8 |
| 30 | 10.0292 | 0.0 |
| 35 | 10.0292 | 0.0 |
| 40 | 10.0292 | 0.0 |
| 45 | 10.0290 | −0.2 |
| 50 | 10.0281 | −1.1 |
| 55 | 10.0277 | −1.5 |
| 60 | 10.0274 | −1.8 |
| 65 | 10.0265 | −2.7 |
| 68 | 10.0255 | −3.7 |

TABLE 7

| Roll 2 | | |
|---|---|---|
| Reference Point (inches) | Diameter of Embossing Roll (inches) | Crown (mils) |
| 1 | 10.0253 | −3.7 |
| 5 | 10.0263 | −2.7 |
| 10 | 10.0272 | −1.8 |
| 15 | 10.0280 | −1.0 |
| 20 | 10.0285 | −0.5 |
| 25 | 10.0288 | −0.2 |
| 30 | 10.0288 | −0.2 |
| 35 | 10.0290 | 0.0 |
| 40 | 10.0290 | 0.0 |
| 45 | 10.0285 | −0.5 |
| 50 | 10.0282 | −0.8 |
| 55 | 10.0277 | −1.3 |
| 60 | 10.0271 | −1.9 |
| 65 | 10.0262 | −2.8 |
| 68 | 10.0252 | −3.8 |

Of note, the above measurements were taken prior to the crowned roll being chromed. According to one embodiment, the embossing rolls can be plated with chrome. Chrome plating provides added durability, increased releasability of the web, and corrosion resistance to the embossing rolls. Co-pending U.S. patent application Ser. No. 10/187,608, which is incorporated herein by reference, discusses, inter alia, wear resistant coating for embossing rolls. After the rolls were chromed, reference points 1 and 68 of the first roll measured −3.7 mils and −3.3 mils, respectively, while reference points 1 and 68 of the second roll measured −3.5 mils and −3.5 mils, respectively.

To determine the effect of the crowned rolls on the caliper profile of the perforate embossed web, a trial was conducted using the crowned rolls. During the trial, paper webs were perforate embossed at an average speed of 520 feet per minute (the minimum and maximum speeds being 472 and 537 feet per minute, respectively) at both full step alignment and half step alignment. The caliper profile was measured as described above. The average delta, i.e., caliper difference between the ends of the roll compared to the middle portion of the web, was −1.8. In comparison, in a similar trial using non-crowned rolls where the paper webs were perforate embossed in both full step and half step alignment at an average speed of 484 feet per minute (the minimum and maximum speeds being 432 and 555 feet per minute, respectively), the average delta was 4.6. Thus, based on the achieved results, crowning the rolls has the effect of reducing the caliper profile of the perforate embossed web.

Those of ordinary skill in the art will understand that various caliper profiles can be achieved by changing the crown profile of the embossing rolls. For example, in the previously discussed example, the caliper profile of the web perforate embossed using non-crowned rolls had a positive profile of 4.6 (i.e., the caliper of the perforated web near the ends of the embossing rolls was greater than that at the middle of the roll). When the described crowned rolls were used, the caliper profile of the web was slightly negative at −1.8, indicating that the caliper of the perforated web near the ends of the embossing rolls was less than that at the middle of the roll. Thus, one of ordinary skill in the art would readily appreciate that a caliper profile of approximately zero could be attained by crowning the rolls by less than the above-described rolls. For example, the rolls could be crowned by approximately 2-3 mils.

Those of ordinary skill in the art will understand that the crowning technique is applicable to other applications, but our experience suggests that it is particularly useful with patterns having substantial numbers of perforate embossing elements in the cross-machine direction.

In yet another embodiment of the present invention, an alignment means is provided for the embossing rolls. In one embodiment, an adjustable collar ring is provided on the first embossing roll. The second embossing roll may have an adjustable collar ring, a fixed collar, a machined keyway, or other means for identifying a particular position of the second embossing roll. In another embodiment of the present invention, scribe marks are provided on each of the first and second embossing rolls.

Figure 42:
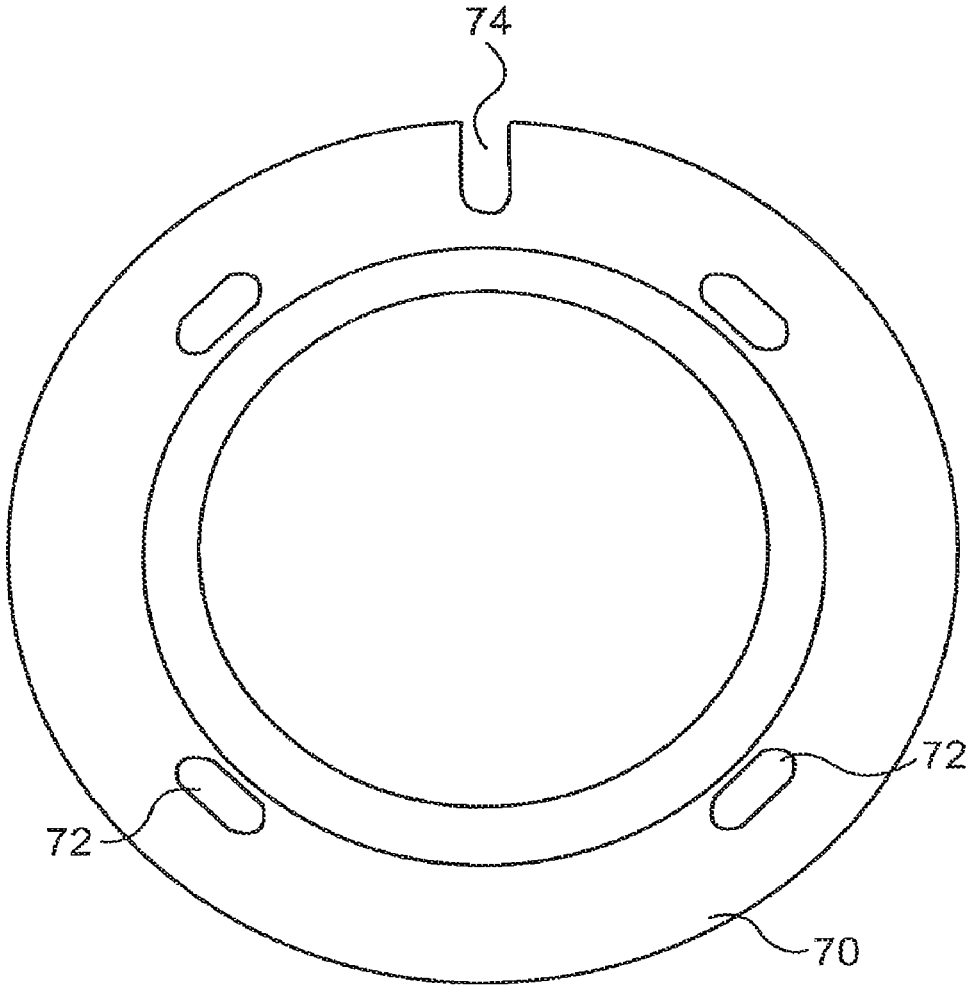
FIG. 42 illustrates an alignment ring usable in an embodiment of the present invention.

In one embodiment an adjustable collar ring is provided on an end of each of the matched embossing rolls. FIG. 42 depicts a collar for use with the present invention. The collar 70 includes a plurality of slots 72 capable of receiving fastening means (not shown) for attaching the collar 70 to an end of the embossing roll. The collar 70 should have at least two slots 72. Those of ordinary skill in the art will understand that more than two slots can be included in the collar. The collar 70 depicted in FIG. 42 has four slots. The collar 70 further includes a keyway 74. The keyway 74 provides the capability of aligning the embossing roll with a second embossing roll having a keyway 74. The collar 70 can be made of various materials, including stainless steel, carbon steel, iron, or other appropriate material known by those of ordinary skill in the art, or later discovered, to be suitable for use as a collar for a roll in a paper making machine.

An alignment process for a first and second embossing roll having first and second adjustable collar rings will now be discussed. In one embodiment of an embossing operation having first and second embossing rolls, each embossing roll will have a collar on one common end. The initial alignment of the embossing rolls is as follows. First, the operator brings the rolls into close proximity, without allowing contact between the cross-machine embossing elements. A web, such as a nip impression paper, is then fed through the embossing roll, leaving an imprint of the location of the elements on the nip impression paper. The imprinted web is then analyzed to determine whether the elements will contact each other when the embossing rolls are brought into closer proximity. Based on the outcome of the imprint, the machine direction alignment of the embossing rolls may be adjusted. After any necessary adjustment, the rolls are brought into closer proximity and a web is once again fed through the embossing rolls to determine the location of the elements. This process is repeated until the embossing rolls, and hence the embossing elements, are in operating engagement position. Once the embossing rolls are in position, the collars are aligned such that the keyways face each other. A key (not shown) is then placed in the opposing keyways to fix the alignment of the collars. The fastening means are then tightened, thereby setting the collars in place. In one embodiment, the adjusted collar is pinned into place to prevent adjustment of the collar after the initial setting.

For subsequent alignment of the embossing rolls, for example, after one or both rolls are removed for maintenance purposes, or the circumferential alignment of either of the rolls is changed for any reason, the rolls are brought into close proximity, the embossing rolls are maneuvered such that the keyways of the opposing collars are facing each other, the key is inserted into the keyways, and then the embossing rolls are brought into engagement. Because the embossing rolls have previously been aligned, the embossing rolls can be brought into engagement without substantial risk of interference of the cross-machine elements. After the embossing rolls are brought into engagement, fine adjustments can then be made.

Using the present invention, the required time to align the embossing rolls to 0.000" engagement after the initial alignment is reduced to approximately one hour or less. The initial alignment of the embossing rolls, described above, can be accomplished either at the fabrication facility or while the rolls are on the paper converting machine. Those of ordinary skill in the art will understand that keying is applicable to other applications, but we have found that it is particular useful for this application wherein perforate embossing elements extend in the cross-machine direction.

This invention can be used in a variety of different processes. The webs in each of the above-described examples were formed in a conventional wet press process. However, the invention is equally applicable when the base web is a through air dried web. In addition, to increase the smoothness of the resulting product, the web may be calendered. Moreover, creping may be carried out using any art recognized creping process. As in one of the examples above, to increase the bulkiness of the product, creping may be carried out using a Taurus creping blade. The patented Taurus blade is an undulatory creping blade disclosed in U.S. Pat. No. 5,690,788, presenting differentiated creping and rake angles to the sheet and having a multiplicity of spaced serrulated creping sections of either uniform depths or non-uniform arrays of depths. The depths of the undulations are above about 0.008 inches. U.S. Pat. No. 5,690,788 is herein incorporated by reference in its entirety. Creping may be carried before or after the web is embossed. Those of ordinary skill in the art will understand the variety of processes in which the above-described invention can be employed.

It is understood that the invention is not confined to the particular construction and arrangement of parts and the particular processes described herein but embraces such modified forms thereof as come within the scope of the following claims.

What is claimed is:

1. An embossing system for embossing at least a portion of a web comprising: a first embossing roll; and a second embossing roll, wherein the first and second embossing rolls define a first nip for receiving the web, and wherein at least one of the first and second rolls has male embossing elements; a third embossing roll, wherein the second and third embossing rolls define a second nip for receiving the web, and wherein at least one of the second and third rolls has male embossing elements; wherein at least a substantial portion of the male embossing elements of at least one of the first, second, and third embossing rolls comprise a plurality of individual elements in juxtaposition with one another and are substantially oriented in the cross-machine direction and, wherein the elements on at least two embossing rolls define a perforate nip for embossing and perforating the web.

2. The embossing system according to claim 1 wherein at least a substantial portion of the embossing elements of at least two of the first, second, and third embossing rolls are substantially oriented in the cross-machine direction.

3. The embossing system according to claim 1 wherein at least a substantial portion of the embossing elements of each of the first, second, and third embossing rolls are substantially oriented in the cross-machine direction.

4. The embossing system according to claim 1 wherein at least a substantial portion of the embossing elements of at least one of the first, second, and third embossing rolls are substantially oriented in the machine direction.

5. The embossing system according to claim 1 wherein at least a substantial portion of the embossing elements of the first and second embossing rolls define perforate nips for embossing and perforating the web.

6. The embossing system according to claim 1 wherein at least a substantial portion of the embossing elements of the second and third embossing rolls define perforate nips for embossing and perforating the web.

* * * * *